US009095213B2

(12) United States Patent
Park et al.

(10) Patent No.: US 9,095,213 B2
(45) Date of Patent: Aug. 4, 2015

(54) SLIDING DEVICE

(75) Inventors: Yoon Sik Park, Seoul (KR); Dong Hee Lee, Seoul (KR); Hyun Ho Cha, Goyang-Si (KR)

(73) Assignee: SEGOS CO., LTD, Incheon (KR)

( * ) Notice: Subject to any disclaimer, the term of this patent is extended or adjusted under 35 U.S.C. 154(b) by 255 days.

(21) Appl. No.: 13/132,457

(22) PCT Filed: Dec. 24, 2009

(86) PCT No.: PCT/KR2009/007808

§ 371 (c)(1),
(2), (4) Date: Jun. 2, 2011

(87) PCT Pub. No.: WO2010/077027

PCT Pub. Date: Jul. 8, 2010

(65) Prior Publication Data

US 2011/0241515 A1 Oct. 6, 2011

(30) Foreign Application Priority Data

Dec. 31, 2008 (KR) ..... 10-2008-0138263
Dec. 31, 2008 (KR) ..... 10-2008-0138264

(51) Int. Cl.

| | |
|---|---|
| ***A47B 88/04*** | (2006.01) |
| ***A47B 88/10*** | (2006.01) |
| ***A47B 88/14*** | (2006.01) |
| ***F24C 15/16*** | (2006.01) |
| ***F25D 23/06*** | (2006.01) |
| ***F25D 25/02*** | (2006.01) |

(52) U.S. Cl.

CPC ..... *A47B 88/10* (2013.01); *A47B 88/14* (2013.01); *F24C 15/168* (2013.01); *F25D 23/067* (2013.01); *F25D 25/025* (2013.01)

(58) Field of Classification Search

CPC . A47B 2210/0032; A47B 88/10; A47B 88/14

USPC ..... 312/334.1, 334.6, 334.7, 334.8, 334.11, 312/334.14, 334.15, 334.16, 334.17, 312/334.25, 334.26, 334.33, 334.36, 312/334.38, 410; 126/332, 337 R, 339; 384/18, 20

See application file for complete search history.

(56) References Cited

U.S. PATENT DOCUMENTS 5,570,943 A 11/1996 Schroeder et al.
5,775,788 A * 7/1998 Sasse et al. ..... 312/334.38
6,132,020 A * 10/2000 Schael et al. ..... 312/334.1

FOREIGN PATENT DOCUMENTS

DE 44 43 063 C1 12/1995

OTHER PUBLICATIONS

International Search Report for PCT/KR2009/007808.
Extended European Search Report dated Apr. 18, 2012 for DP 09 83 6348 (which is a counterpart foreign application).

* cited by examiner

*Primary Examiner* — James O Hansen
(74) *Attorney, Agent, or Firm* — The PL Law Group, PLLC

(57) ABSTRACT

A movable rail body is fastened to a movable body and has a first space. Movable rail bearings are disposed in the first space at diagonally facing corners of the movable rail body. A stationary rail body is fastened to a stationary support and has a second space. Stationary rail bearings are disposed in the second space at diagonally facing corners of the stationary rail body. A slider has an upper end in rolling contact with the movable rail bearings, and a lower end in rolling contact with the stationary rail bearings. An angle between a center line parallel to the movable body and a connection line connecting centers of the movable rail bearings ranges from 40 degrees to 50 degrees. An angle between the center line and a connection line connecting centers of the stationary rail bearings ranges from 130 degrees to 140 degrees.

19 Claims, 14 Drawing Sheets

PRIOR ART

SLIDING DEVICE

CROSS REFERENCE TO RELATED APPLICATION AND CLAIM OF PRIORITY

The present application claims all benefits accruing under 35 U.S.C. §365(c) from the PCT International Application PCT/KR2009/007808, with an International Filing Date of Dec. 24, 2009, which claims the benefit of Korean patent application Nos. 10-2008-0138263 and 10-2008-0138264 filed in the Korean Intellectual Property Office on Dec. 31, 2008, the entire contents of which are incorporated herein by reference.

BACKGROUND

1. Technical Field

The present invention relates to a sliding device.

2. Background Art

Generally, a sliding device is installed between a stationary support and a movable body which slides with respect to the stationary support to enable a user to put an object into the movable body to store it or extract the object therefrom. The sliding device is configured so as to be slidable so that the movable body is easily extracted from or refracted into the stationary support. A drawer which can store objects therein and is a container with no lid is a representative example of such a movable body. Typically, drawers are connected to sliding devices fastened to stationary supports, such as furniture, refrigerators, ovens, casings of electronic products, etc.

As stated above, sliding devices are used in a variety of stationary supports. Such stationary supports can include all objects to which the sliding devices can be fastened. The movable bodies are objects which can be extracted from or retracted into the stationary supports. Such movable bodies can include all objects which can be connected to the sliding devices and slide with respect to the stationary supports.

In this specification, for the sake of explanation, such a movable body will be designated as a drawer, and such a stationary support will be designated as furniture.

Of course, it will be easily understood that the drawer implies all movable bodies, and the furniture implies all stationary supports.

Drawers are provided in various kinds of furniture so that the drawers are extracted from furniture to open and retracted thereinto to close. Drawers have no lid so that when they open, users can easily observe objects contained in the drawers and easily take them out of the drawers. When the drawers are closed, they are completely retracted into the furniture without a protruding portion. Thus, the appearance of the furniture can be maintained as superior or decorative. Therefore, the drawers are widely used in furniture, such as desks, wardrobes, dressing tables, stationery cases, etc., because of the facility of storage of objects or removing them.

As mentioned above, a drawer slides with respect to furniture when it is extracted from or retracted into the furniture. Typically, sliding devices are provided at both sides of the drawer so that the drawer can slide with respect to the furniture.

Sliding devices are classified into a double-folding type and a triple-folding type. A triple-folding type sliding device includes a stationary member which is fastened to furniture, an intermediate member, and a movable member which is fastened to a drawer. The first end of the intermediate member comes into rolling contact with the stationary member, and a second end thereof comes into rolling contact with the movable member. Thereby, the movable member is slidably connected to the stationary member. Rolling tracks are formed on the first and second ends of the intermediate member to bring the intermediate member into rolling contact with the stationary member and the movable member. In addition, rail tracks are formed in the stationary member and the movable member at positions corresponding to the rolling tracks. Balls are provided between the rolling tracks and the rail tracks. When a user pulls a drawer, the balls roll in the sliding device so that the drawer smoothly slides outward with respect to the furniture. Thus, the drawer can be easily extracted from the furniture. When the user pushes the drawer which has been extracted, the drawer smoothly slides inward with respect to the furniture due to the rolling motion of the balls, so that the drawer can be easily retracted into the furniture.

Meanwhile, force generated by the weight of the drawer and objects contained in the drawer is applied to the drawer which is extracted from or retracted into the furniture. The force is transmitted to the furniture via the sliding devices provided at both sides of the drawer. Therefore, the sliding device must have a structure that can resist such force.

FIG. 1 is a sectional view showing a conventional sliding device 10 disclosed in U.S. Pat. No. 6,132,020. As shown in FIG. 1, the conventional sliding device 10 includes a movable member 13, a stationary member 17 and an intermediate member 14 which is interposed between the movable member 13 and the stationary member 17.

In the conventional sliding device 10, the stationary member 17 is fastened to a sidewall panel 16 of a body of, for example, a desk, by an extension 12. The movable member 13 is fastened to the lower surface of a drawer panel 11. Three tracks are formed on each of both ends of the intermediate member 14.

Balls 15 are provided between the movable member 13 and the intermediate member 14 and between the intermediate member 14 and the stationary member 17. The balls 15 roll along the corresponding tracks so that the intermediate member 14 slides along the stationary member 17 and the movable member 13 slides along the intermediate member 14. Accordingly, the sliding device 10 is generally operated in a triple folding manner.

In this conventional sliding device 10 of U.S. Pat. No. 6,132,020, three rows of tracks are formed on the upper and lower sides in a shape in which they face each other to offer resistance to the force. The movable member 13 is open both on a side surface which is adjacent to the center of the drawer panel 11 and on the bottom thereof. The movable member 13 has tracks formed on an upper corner which is adjacent to the center of the drawer panel 11 and on upper and lower corners which are adjacent to the sidewall panel 16. The stationary member 17 is open both on a side surface which is adjacent to the center of the sidewall panel 16 and on the top thereof. The stationary member 17 has tracks formed on a lower corner which is adjacent to the sidewall panel 16 and on upper and lower corners which are adjacent to the center of the drawer panel 11. The intermediate member 14 has tracks at corresponding positions such that the tracks of the intermediate member 14 come into rolling contact with the balls which are in rolling contact with the tracks formed on the movable member 13 and the stationary member 17.

In the conventional sliding device 10, as shown in the sectional view of sliding device 10, the balls 15 which are located in the movable member 13 at the upper and lower positions adjacent to the sidewall panel 16 and the ball 15 which is located at the upper position adjacent to the center of the drawer panel 11 form an approximately triangular shape. These balls 15 along with the intermediate member 14 support the force generated by the weight of the drawer panel 11 and objects contained in the drawer. Furthermore, the balls 15 which are located in the stationary member 17 at the upper and lower positions adjacent to the center of the drawer panel 11 and the ball 15 which is located at the upper position adjacent to the sidewall panel 16 form an approximately triangular shape. These balls 15 along with the intermediate member 14 support the force. In other words, the corresponding balls 15 are located on the upper end of the intermediate member 14 into a triangular shape of which the vertex is oriented toward the sidewall panel 16. In addition, the corresponding balls 15 are located on the lower end of the intermediate member 14 at positions facing the balls 15 on the upper end thereof into a triangular shape of which the vertex is oriented toward the center of the drawer panel 11. As such, in the conventional sliding device 10, the balls 15 are disposed at both sides of the lower surface of the drawer panel 11 so that the balls face each other with respect to the vertical direction. Hence, the sliding device 10 can offer resistance to a force applied thereto downward.

However, the conventional sliding device is configured so that six rows of tracks on the upper and lower sides are formed, and the movable member, the stationary member and the intermediate member come into rolling contact with the balls to form the sliding structure. Thus, the structure of the six rows of tracks and the rolling structure of the balls in contact with the tracks make it difficult to reduce the volume of the sliding device.

Furthermore, because the conventional sliding device requires the forming of the six tracks on the intermediate member, the shape of the intermediate member is complicated, so that it must be manufactured by bending a plate several times into a complex shape. Manufacturing the intermediate member with the complex shape causes an increase in the production cost.

Moreover, when the drawer is extracted from the furniture, force generated by the weight of the drawer and the objects contained in the drawer is concentrated on a lower portion of the drawer in the direction in which the drawer is extracted. This force concentrated on the lower portion of the drawer acts as torsional force applied to the sliding devices which are fastened to both sides of the drawer. In other words, when the force is concentrated on the lower portion of the drawer in the extraction direction, torsional force is applied toward the center of the drawer to each of the sliding devices which are located at both sides of the drawer. However, in the conventional sliding device, because the six rows of tracks are formed facing each other in the movable member coupled to the drawer and the stationary member fastened to the sidewall panel of the desk so as to offer resistance to the force applied to the drawer panel in the vertical direction, resistance to torsional force applied to the sliding device toward the center of the drawer is markedly reduced. In detail, because the six rows of tracks and the balls seated into the tracks are configured so as to offer resistance to force applied to the drawer downward, they may be easily influenced by torsional force. As such, in the conventional sliding device, the six rows of tracks disposed at both sides of the drawer so as to resist force applied to the drawer downward in the vertical direction and the balls provided on the respective tracks cannot reliably resist the torsional force applied to the sliding device toward the center of the drawer.

When such torsional force is applied to the conventional sliding device for a long period of time, the movable member and the stationary member may be deformed, thus increasing the clearance of the drawer. As a result, the lifespan of the sliding device may be reduced.

Moreover, after the drawer has been extracted, downward force is applied to the outer end of the sliding device that is a leading end with respect to the extraction direction of the drawer, and upward force is applied to the inner end of the sliding device that is opposite to the leading end. The upward force and the downward force are uniformly dispersed when the number of tracks is two to the power of n, where n is an integer. In other words, in a sliding device, the number of tracks which are provided between the intermediate member and each of the movable and stationary members coming into rolling contact with the intermediate member must be the power of two, so as to uniformly disperse the upward force and the downward force. That is, in the case where the number of tracks is the power of two, one ball which comes into rolling contact with each track and another ball which corresponds to the ball are present in a pair so that the force applied to the sliding device can be uniformly dispersed. However, in the conventional sliding device, the three rows of tracks and the balls seated on the tracks are provided in each of the movable member and the stationary member. Thus, the upward force and the downward force are concentrated on a spot of the sliding device rather than being uniformly dispersed. Such concentration of force increases the clearance of the drawer with respect to a specific direction and causes torsion deformation of the drawer.

Therefore, a sliding device which can reliably support force applied to a drawer despite a minimized number of bearings is required.

In particular, development of a sliding device is required, which is configured so that when it is installed at each of both sides of a drawer and supports the weight of the drawer, resistance to torsional force applied thereto toward the center of the drawer is enhanced so that the lifespan thereof can be extended.

SUMMARY

Accordingly, the present invention has been made keeping in mind the above problems occurring in the prior art, and an object of the present invention is to provide a sliding device which has a simple structure and is able to stably support various types of forces applied to a movable body, so that the forces applied thereto are effectively dispersed, thus extending the lifespan, and reducing the size of the sliding device.

To accomplish the above object, in a first embodiment of the present invention, a sliding device is fastened to a stationary support to connect a movable body to the stationary support so that the movable body is movable with respect to the stationary support. The sliding device includes: a movable rail body disposed under each of both sides of the movable body, the movable rail body being open on a bottom thereof, with a first space defined in the movable rail body; movable rail bearings disposed in the first space at opposite corners of the movable rail body which diagonally face each other, the movable rail bearings rolling in contact with the movable rail body; a stationary rail body fastened to the stationary support and disposed below the movable rail body so that the movable rail body overlaps with the stationary rail body, the stationary rail body being open on a top thereof, with a second space defined in the stationary rail body; stationary rail bearings disposed in the second space at opposite corners of the stationary rail body which diagonally face each other, the stationary rail bearings rolling in contact with the stationary rail body; and a slider inserted into the first space through the open bottom of the movable rail body and into the second space through the open top of the stationary rail body, the slider having an upper end in rolling contact with the movable rail bearings, and a lower end in rolling contact with the stationary rail bearings. The movable rail bearings are disposed facing each other so that an angle between a center line extending from a center of the slider in a direction parallel to the movable body and a center connection line connecting centers of the movable rail bearings facing each other ranges from 40 degrees to 50 degrees. The stationary rail bearings are disposed facing each other so that an angle between the center line extending from the center of the slider in the direction parallel to the movable body and a center connection line connecting centers of the stationary rail bearings facing each other ranges from 130 degrees to 140 degrees. The movable rail bearings and the stationary rail bearings are respectively disposed above and below the center of the slider and are symmetric with respect to the center line of the slider.

The sliding device may further include a mounting bracket protruding from the stationary rail body toward the stationary support so that the stationary rail body is fastened to the stationary support by the mounting bracket.

Furthermore, round movable rail tracks may be formed on inner surfaces of the opposite corners of the movable rail body that are in contact with the corresponding movable rail bearings. Round stationary rail tracks may be formed on inner surfaces of the opposite corners of the stationary rail body that are in contact with the corresponding stationary rail bearings.

The slider may include a movable rail rolling part located in the movable rail body, the movable rail rolling part having movable rail connection tracks coming into rolling contact with the movable rail bearings facing each other; a stationary rail rolling part located in the stationary rail body, the stationary rail rolling part having stationary rail connection tracks coming into rolling contact with the stationary rail bearings facing each other; and a connection part connecting the movable rail rolling part to the stationary rail rolling part, the connection part being inserted into the first space and the second space through the open bottom of the movable rail body and the open top of the stationary rail body. The movable rail rolling part, the stationary rail rolling part and the connection part may be integrally formed by bending a single plate. The movable rail rolling part and the stationary rail rolling part may be symmetric on upper and lower ends of the connection part with respect to the connection part.

Preferably, a plurality of first bent portions may be formed in the movable rail rolling part so that the movable rail connection tracks coming into rolling contact with the movable rail bearings facing each other are formed on the movable rail rolling part. A plurality of second bent portions may be formed in the stationary rail rolling part so that the stationary rail connection tracks coming into rolling contact with the stationary rail bearings facing each other are formed on the stationary rail rolling part.

Furthermore, a first curled portion may extend from an end of the first bent portions and be curled into the movable rail rolling part. A second curled portion may extend from an end of the second bent portions and be curled into the stationary rail rolling part.

The sliding device of the first embodiment of the present invention may be installed in furniture.

The sliding device of the first embodiment of the present invention may be installed in a refrigerator.

The sliding device of the first embodiment of the present invention may be installed in an oven.

To accomplish the above object, in a second embodiment of the present invention, a sliding device is fastened to a stationary support to connect a movable body to the stationary support so that the movable body is movable with respect to the stationary support. The sliding device includes: a movable rail disposed under each of both sides of the movable body, with a first space defined in the movable rail; a stationary rail fastened to the stationary support and disposed below the movable rail, with a second space defined in the stationary rail; bearings provided on opposite corners diagonally facing each other in each of the first and second spaces, the bearings rolling in contact with the movable rail and the stationary rail; and a slider inserted into the first space and the second space, the slider coming into rolling contact with the bearings so that the movable body slides with respect to the stationary support. When a first extension line connecting centers of the bearings provided on the opposite corners diagonally facing each other in the first space extends toward the movable body and a second extension line connecting centers of the bearings provided on the opposite corners diagonally facing each other in the second space extends toward the movable body, an angle between the first and second extension lines ranges from 80 degrees to 100 degrees. The slider is integrally solid and has a cross section of which a contour forms a closed curve.

The movable rail may include a movable rail body fastened under each of both the sides of the movable body, the movable rail body being open on a bottom of the first space, and movable rail tracks formed on the opposite corners diagonally facing each other in the first space, the movable rail tracks coming into rolling contact with the corresponding bearings.

The stationary rail may include: a stationary rail body disposed below the movable rail such that the movable rail overlaps with the stationary rail body, the stationary rail body being open on a top of the second space; a mounting bracket fastening the stationary rail body to the stationary support; and stationary rail tracks formed on the opposite corners diagonally facing each other in the second space, the stationary rail tracks coming into rolling contact with the corresponding bearings.

The slider may include: a movable rail-side sliding part disposed in the movable rail, the movable rail-side sliding part having movable rail connection tracks coming into rolling contact with the corresponding bearings provided on the opposite corners diagonally facing each other; a stationary rail-side sliding part disposed in the stationary rail, the stationary rail-side sliding part having stationary rail connection tracks coming into rolling contact with the corresponding bearings provided on the opposite corners diagonally facing each other; and a connection part connecting the movable rail-side sliding part to the stationary rail-side sliding part, the connection part being inserted into the open bottom of the movable rail and the open top of the stationary rail. The movable rail-side sliding part, the stationary rail-side sliding part and the connection part may form a solid integrated structure having a cross section of which a contour forms a closed curve.

The sliding device of the second embodiment of the present invention may be installed in furniture.

The sliding device of the second embodiment of the present invention may be installed in a refrigerator.

The sliding device of the second embodiment of the present invention may be installed in an oven.

DETAILED DESCRIPTION

Figure 1:
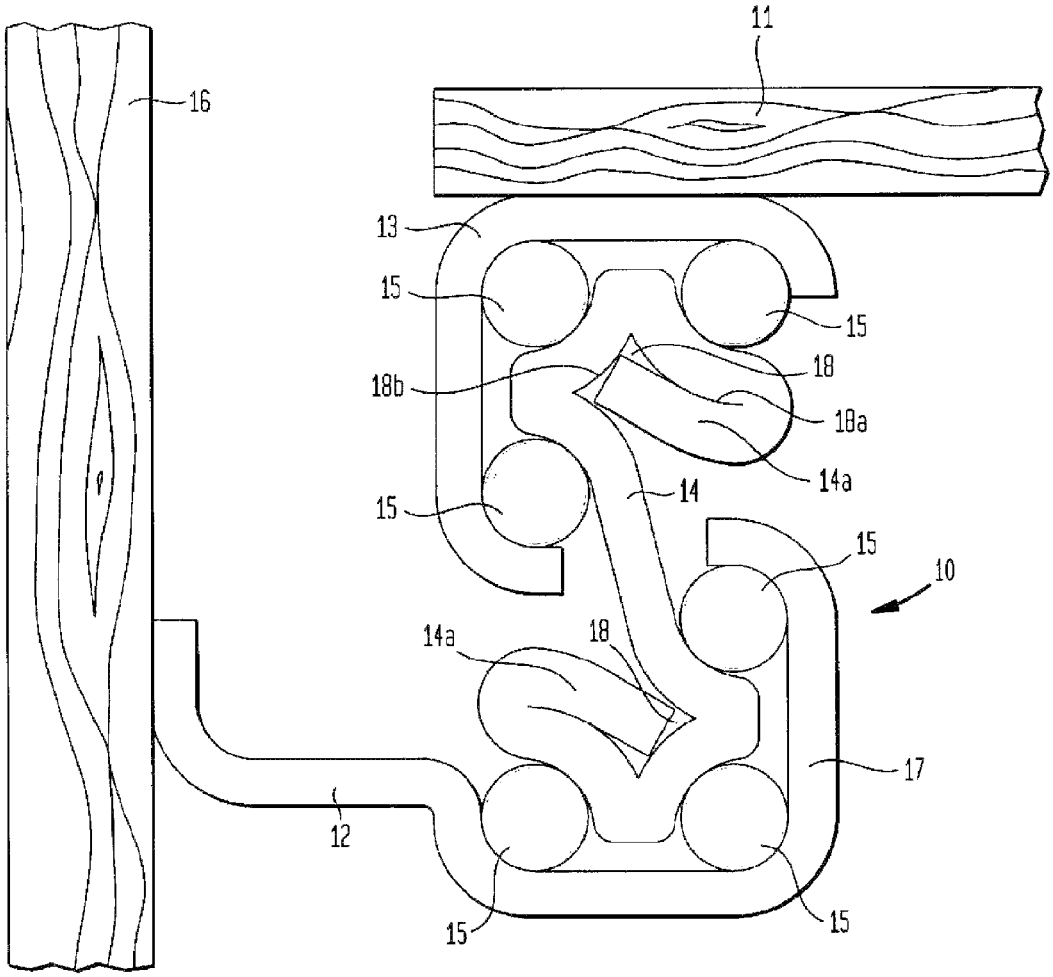
FIG. 1 is a sectional view of a sliding device, according to a conventional technique.

Hereinafter, embodiments of the present invention will be described in detail with reference to the attached drawings. The embodiments are only examples proposed to illustrate the present invention in detail so that those skilled in the art can easily implement the present invention, and they must not be regarded as limiting the scope and spirit of the present invention. Reference now should be made to the drawings, in which the same reference numerals are used throughout the different drawings to designate the same or similar components.

A sliding device according to a first embodiment of the present invention will be described in detail with reference to FIGS. 2 through 4.

For the sake of explanation of the present invention, in the embodiment, a movable body is designated as a drawer, and a stationary support is designated as furniture.

In other words, it is obvious that a drawer implies all typical objects which slide with respect to stationary supports, and furniture implies all typical stationary supports.

Figure 2:
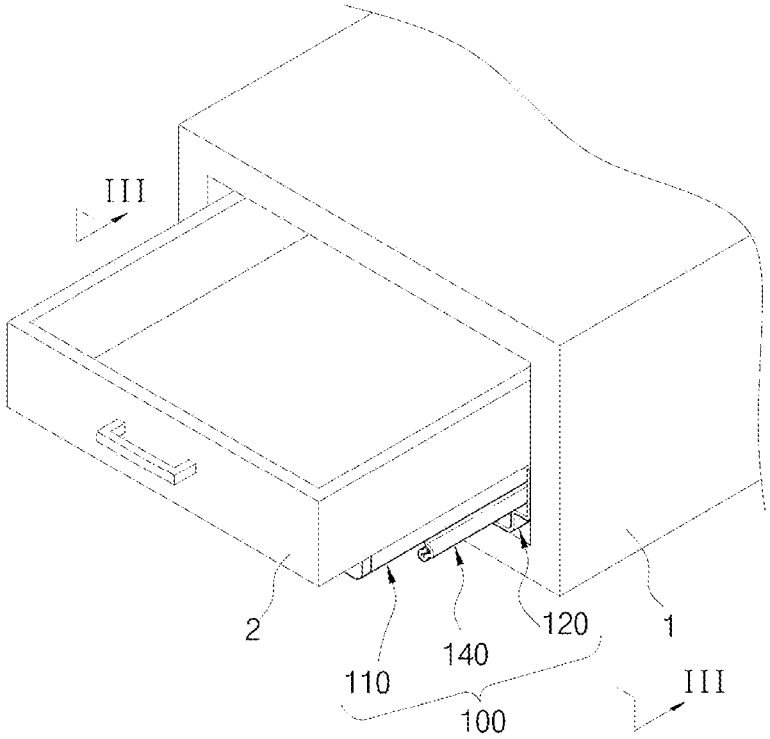
FIG. 2 is a perspective view illustrating the installation of a sliding device, according to a first embodiment of the present invention.

FIG. 2 is a perspective view illustrating the installation of a sliding device, according to a first embodiment of the present invention. FIG. 3 is a sectional view taken along line III-III of FIG. 2. FIG. 4 is a partial sectional view showing a main portion of the sliding device of FIG. 2.

Figure 3:
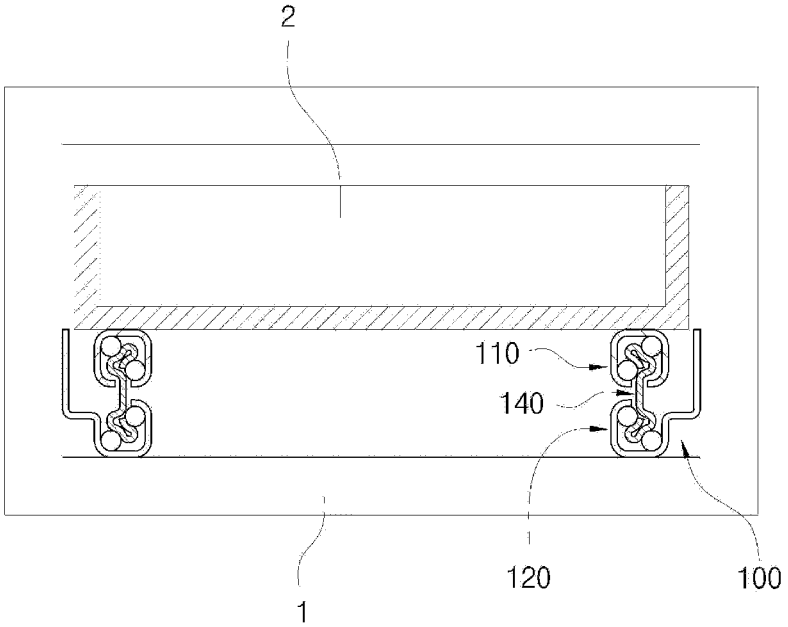
FIG. 3 is a sectional view taken along line III-III of FIG. 2.
Figure 4:
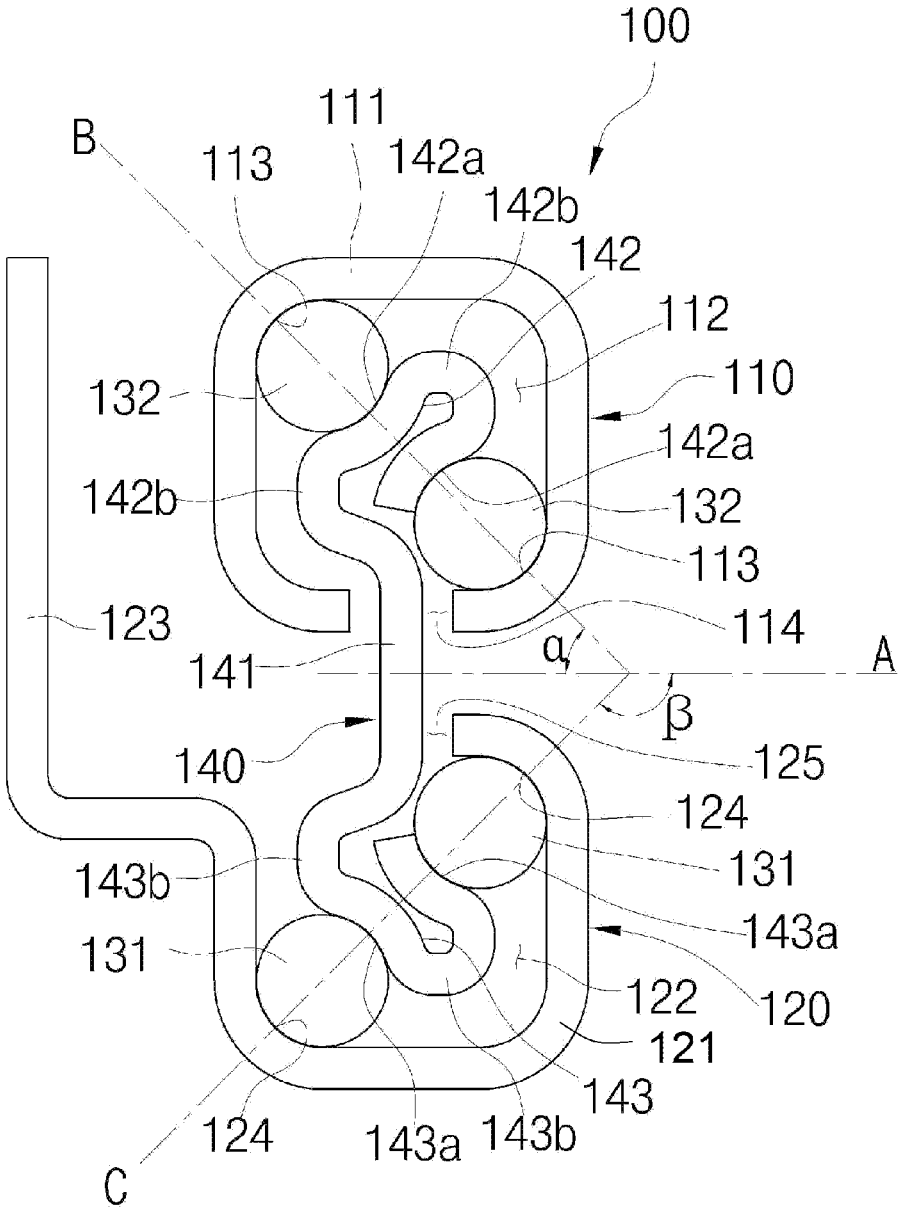
FIG. 4 is a partial sectional view showing a main portion of the sliding device of FIG. 2.

Referring to FIGS. 2 through 4, the sliding device 100 according to the first embodiment of the present invention includes a movable rail 110, a stationary rail 120 and a slider 140.

The movable rail 110 includes a movable rail body 111 which is provided under each of both sides of a drawer 2, and movable rail bearings 132. The movable rail bodies 111 of two movable rails 110 are fastened to both sides of the bottom of the drawer 2 to support it. Each movable rail body 111 has four corners. A connection opening 114 is formed through the bottom of the movable rail body 111. A movable sliding space 112 is formed in the movable rail body 111. Round movable rail tracks 113 are respectively formed in the movable sliding space 112 at corners which diagonally face each other, in detail, at a first-side upper corner that is adjacent to the furniture 1 and a second-side lower corner that is adjacent to the center of the drawer 2.

The movable rail bearings 132 are configured so as to be able to roll. The movable rail bearings 132 are located on the respective movable rail tracks 113 diagonally facing each other. Each movable rail bearing 132 is in rolling contact with the corresponding movable rail track 113. The movable rail 110 slides in such a way that the movable rail bearings 132 roll along the corresponding movable rail tracks 113. The movable rail bearing 132 which is in rolling contact with the corresponding movable rail track 113 may include a plurality of movable rail bearings 132 depending on the length of the movable rail 110.

The stationary rail 120 includes a stationary rail body 121 which is fastened to the furniture 1 at a location corresponding to the installation location of the drawer 2, and stationary rail bearings 131. In this embodiment, the stationary rail 120 includes stationary rails 120 which are fastened to both sides of the furniture 1 under the installation location of the drawer 2. Each stationary rail 120 is located under the corresponding movable rail body 111 so that the movable rail body 111 overlaps with the stationary rail 120. The stationary rail body 121 has three corners. A connection opening 125 is formed through a portion of the top of the stationary rail body 121. A stationary sliding space 122 is formed in the stationary rail body 121. Round stationary rail tracks 124 are respectively formed in the stationary sliding space 122 at corners which diagonally face each other, in detail, at a first-side lower corner that is adjacent to the furniture 1 and a second-side upper corner that is adjacent to the center of the drawer 2. An extension mounting bracket 123 extends from a side of the stationary rail body 121 which is adjacent to the furniture 1 so that the stationary rail body 121 is fastened to the furniture 1 by the extension mounting bracket 123. A means for fastening the stationary rail body 121 to the furniture 1 is formed on the extension mounting bracket 123.

The stationary rail bearings 131 are configured so as to be able to roll. The stationary rail bearings 131 are located on the respective stationary rail tracks 124 diagonally facing each other. Each stationary rail bearing 131 is in rolling contact with the corresponding stationary rail track 124. The slider 140 slides in such a way that the stationary rail bearings 131 roll along the corresponding stationary rail tracks 124. The stationary rail bearing 131 which is in rolling contact with the corresponding stationary rail track 124 may include a plurality of stationary rail bearings 131 depending on the length of the stationary rail 120.

The two movable rail tracks 113 are respectively formed in the movable sliding space 112 at the first-side upper corner and the second-side lower corner. The two stationary rail tracks 124 are respectively formed in the stationary sliding space 122 at the first-side lower corner and the second-side upper corner which are symmetric with respect to the slider 140. Thus, the movable rail tracks 113 and the stationary rail tracks 124 which are in rolling contact with the movable rail bearings 132 and the stationary rail bearings 131 are symmetric with respect to a horizontal plane including the center of the slider 140.

In other words, of the movable rail tracks 113 and the stationary rail tracks 124 which are in rolling contact with the movable rail bearings 132 and the stationary rail bearings 131, the first-side tracks 113 and 124 are respectively located at the first side adjacent to the furniture 1 in the movable rail body 111 and the stationary rail body 121 so that the first-side tracks 113 and 124 are spaced as far apart from each other as possible. The second-side tracks 113 and 124 are respectively located at the second side adjacent to the center of the drawer 2 in the movable rail body 111 and the stationary rail body 121 so that the second-side tracks 113 and 124 are as near to each other as possible.

Accordingly, because the movable rail bearing 132 and the stationary rail bearing 131 that are located at the first side adjacent to the furniture 1 are spaced as far apart from each other as possible within a range allowed in the movable rail 110 and the stationary rail 120, the resistance to force applied outward to the drawer 2 can be enhanced. Furthermore, because the movable rail bearing 132 and the stationary rail bearing 131 that are located at the second side adjacent to the center of the drawer 2 are as near to each other as possible within a range allowed in the movable rail 110 and the stationary rail 120, the resistance to force applied to the drawer 2 inward, that is, toward the center of the drawer 2, can be enhanced.

The movable rail tracks 113 and the stationary rail track 124 with which the movable rail bearings 132 and the stationary rail bearings 131 are in rolling contact are symmetric with respect to the horizontal plane and include two movable rail tracks 113 and two stationary rail tracks 124, which are the minimum number so that the tracks 113 and 124 allow the rollers to roll along them and are resistant to forces applied to the drawer outward and inward. Therefore, friction in the sliding of the sliding device 100 can be minimized, and the size of the sliding device 100 can be reduced.

In the embodiment, although the movable rail bearings 132 and the stationary rail bearings 131 have been illustrated as having ball shapes, all typical rolling means can be used as them. For example, not only a ball but also a roller or the like which is able to roll may be used as each bearing 131, 132.

The slider 140 includes a connection part 141, a movable rail rolling part 142 and a stationary rail rolling part 143. The connection part 141 is located between the movable rail 110 and the stationary rail 120. The connection part 141 is inserted into the movable sliding space 112 and the stationary sliding space 122 through the connection opening 114 and the connection opening 125.

The movable rail rolling part 142 is provided on the upper end of the connection part 141 and located in the movable sliding space 112. Movable rail connection tracks 142*a* are formed on the movable rail rolling part 142 at positions opposing to each other and are in rolling contact with the corresponding movable rail bearings 132. The movable rail rolling part 142 is installed in the movable rail body 111 so that it is in rolling contact with the movable rail bearings 132 to enable the movable rail 110 to slide with respect to the slider 140.

The stationary rail rolling part 143 is provided on the lower end of the connection part 141 and located in the stationary sliding space 122. Stationary rail connection tracks 143*a* are formed on the stationary rail rolling part 143 at positions opposite to each other and are in rolling contact with the corresponding stationary rail bearings 131. The stationary rail rolling part 143 is installed in the stationary rail body 121 so that it is in rolling contact with the stationary rail bearings 131 to enable the slider 140 to slide with respect to the stationary rail 120.

Therefore, the movable rail rolling part 142 which is provided on the upper end of the connection part 141 comes into rolling contact with the movable rail bearings 132 and slidably supports the movable rail body 111 which is fastened to the drawer 2. In addition, the stationary rail rolling part 143 which is provided on the lower end of the connection part 141 comes into rolling contact with the stationary rail bearings 131 and supports the movement of the slider 140, which interlocks with the movable rail body 111 and slides with respect to the stationary rail body 121 fastened to the furniture 1.

Meanwhile, when a line extending from the center of the connection part 141 in the direction parallel to the drawer 2 is designated as a reference line A and a line extending through the centers of the movable rail bearings 132 is designated as a center connection line B, an angle $\alpha$ between the reference line A and the center connection line B ranges from 40 degrees to 50 degrees. The optimum value of the angle $\alpha$ between the reference line A and the center connection line B is 45 degrees. Furthermore, when a line extending through the centers of the stationary rail bearings 131 is designated as a center connection line C, an angle $\beta$ between the reference line A and the center connection line C ranges from 130 degrees to 140 degrees. The optimum value of the angle $\beta$ between the reference line A and the center connection line C is 135 degrees.

If the angle $\alpha$ between the reference line A and the center connection line B is less than 40 degrees and the angle $\beta$ between the reference line A and the center connection line C is greater than 140 degrees, the distance between the first-side movable rail bearing 132 and the first-side stationary rail bearing 131 that are adjacent to the furniture 1 is reduced, thus reducing the resistance to outward force applied to the drawer. If the outward force is continuously applied to the drawer for a long period of time, the movable rail 110 and the stationary rail 120 may deform.

Furthermore, if the angle $\alpha$ between the reference line A and the center connection line B is greater than 50 degrees and the angle $\beta$ between the reference line A and the center connection line C is less than 130, the distance between the first-side movable rail bearing 132 and the first-side stationary rail bearing 131 that are adjacent to the furniture 1 is increased, thus reducing the resistance to the inward force applied to the drawer. If inward force is continuously applied to the drawer for a long period of time, the movable rail 110 and the stationary rail 120 may deform.

Therefore, to enhance the resistance to the force, it is desirable that the angle $\alpha$ between the reference line A and the center connection line B range from 40 degrees to 50 degrees and the angle $\beta$ between the reference line A and the center connection line C ranges from 130 degrees to 140 degrees.

Moreover, the center connection line B extending through the centers of the movable rail bearings 132 and the center connection line C extending through the centers of the stationary rail bearings 131 are at right angles (90 degrees) to each other within the desirable ranges of the angles $\alpha$ and $\beta$. Accordingly, the movable rail bearings 132 and the stationary rail bearing 131 are provided on the lines which are perpendicular to each other and located at the positions corresponding to the centers of the relative corners of the movable rail body 111 and the stationary rail body 121. Therefore, the stability with respect to forces applied to the drawer in a variety of directions can be enhanced. Because the movable rail bearings 132 and the stationary rail bearings 131 are located at the optimum positions at which the resistance to the force applied to the drawer is enhanced, the sliding device is prevented from being damaged or deformed by the force applied thereto, thus extending its lifespan.

In the embodiment, the connection part 141, the movable rail rolling part 142 and the stationary rail rolling part 143 of the slider 140 are integrally formed using a single plate. The movable rail rolling part 142 is integrally formed using a single plate on the upper end of the connection part 141. The movable rail connection tracks 142*a* which are in rolling contact with the movable rail bearings 132 facing each other in the movable sliding space 112 are formed on the movable rail rolling part 142 at positions opposite to each other. The movable rail rolling part 142 has a plurality of bent portions 142*b* which are integrally formed by bending the single plate to form the movable rail connection tracks 142*a* thereon.

In detail, the integrally formed plate is bent from the connection part 141 upward and toward the first-side lower corner of the movable sliding space which is adjacent to the furniture 1. The bent plate extends from the first-side lower corner of the movable sliding space 112 to the second-side upper corner which is toward the center of the drawer, so that the plate is rounded to form the movable rail connection track 142*a* on the upper surface thereof. This movable rail connection track 142*a* is in rolling contact with a second-side lower portion of the movable rail bearing 132 which is in rolling contact with the first-side upper corner of the movable sliding space 112. The plate which has been bent toward the second-side upper corner of the movable sliding space 112 is bent toward the first-side lower corner of the movable sliding space 112 and is rounded to form the movable rail connection track 142*a* on the lower surface thereof. This movable rail connection track 142*a* is in rolling contact with the first-side upper portion of the movable rail bearing 132 which is in rolling contact with the second-side lower corner of the movable sliding space 112. Accordingly, the bent portions 142*b* are formed on the plate extending from the upper end of the connection part 141 so that the movable rail rolling part 142 having the movable rail connection tracks 142*a* which are in rolling contact with the movable rail bearings 132 is formed on the plate.

The stationary rail rolling part 143 is integrally formed using a single plate on the lower end of the connection part 141. The stationary rail connection tracks 143*a* which are in rolling contact with the stationary rail bearings 131 facing each other in the stationary sliding space 122 are formed on the stationary rail rolling part 143 at positions opposite to each other. The stationary rail rolling part 143 has a plurality of bent portions 143*b* which are integrally formed by bending the single plate to form the stationary rail connection tracks 143*a* thereon.

In detail, the integrally formed plate is bent from the connection part 141 downward and toward the first-side upper corner of the stationary sliding space 122 which is adjacent to the furniture 1. The bent plate extends from the first-side upper corner of the stationary sliding space 122 to a second-side lower corner which faces the first-side upper corner, so that the plate is rounded to form the stationary rail connection track 143*a* on the lower surface thereof. This stationary rail connection track 143*a* is in rolling contact with a second-side upper portion of the stationary rail bearing 131 which is in rolling contact with the first-side lower corner of the stationary sliding space 122. The plate which has been bent toward the second-side lower corner of the stationary sliding space 122 is bent toward the first-side upper corner of the stationary sliding space 122 and is rounded to form the stationary rail connection tracks 143*a* on the upper surface thereof. This stationary rail connection track 143*a* is in rolling contact with a first-side lower portion of the stationary rail bearing 131 which is in rolling contact with the second-side upper corner of the stationary sliding space 122. As such, the bent portions 143*b* are formed on the plate extending from the lower end of the connection part 141 so that the stationary rail rolling part 143 having the stationary rail connection tracks 143*a* which are in rolling contact with the stationary rail bearings 131 is formed on the plate.

Meanwhile, a modification of the slider of the sliding device for a drawer will be described with reference to FIG. 5.

Figure 5:
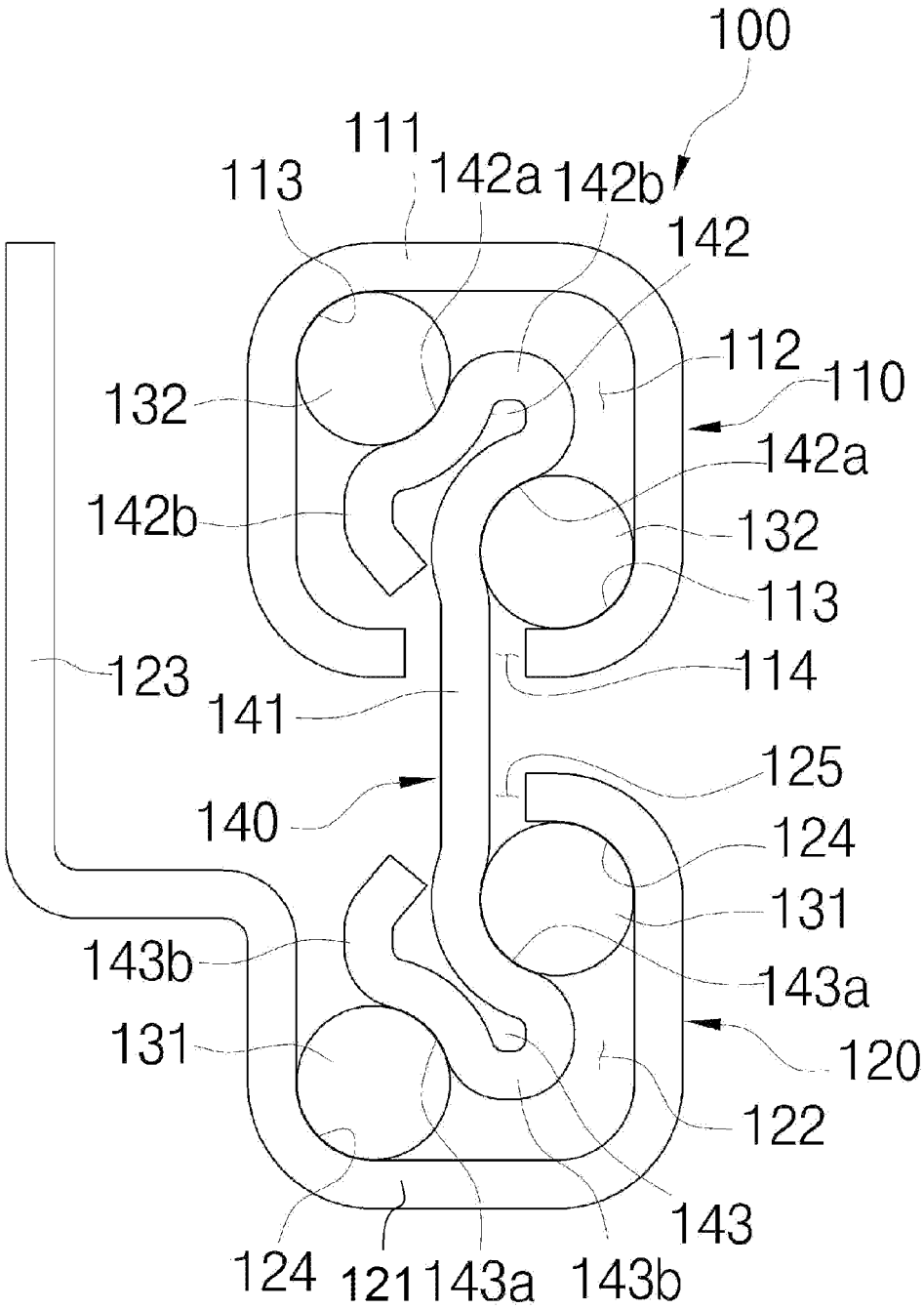
FIG. 5 is a sectional view showing a modification of a slider installed in the sliding device of FIG. 2.

Referring to FIG. 5, a movable rail rolling part 142 has a plurality of bent portions 142*b* which are formed by bending a single plate to form the movable rail connection tracks 142*a* on the movable rail rolling part 142.

The movable rail rolling part 142 is integrally formed using a single plate on the upper end of the connection part 141. The integrally formed plate is bent from the connection part 141 upward and toward a second-side upper corner of the movable sliding space 112 which is toward the center of the drawer 2 so that the plate is rounded to form the movable rail connection track 142*a* on the lower surface thereof. This movable rail connection track 142*a* is in rolling contact with the first-side upper portion (adjacent to the furniture 1) of the movable rail bearing 132 which is in rolling contact with the second-side lower corner of the movable sliding space 112. The plate which has been bent toward the second-side upper corner of the movable sliding space 112 is bent toward the first-side lower corner of the movable sliding space 112 and is rounded to form the movable rail connection track 142*a* on the upper surface thereof. This movable rail connection track 142*a* is in rolling contact with a second-side lower portion of the movable rail bearing 132 which is in rolling contact with the first-side upper corner of the movable sliding space 112. The plate which has been bent toward the first-side lower corner of the movable sliding space 112 is bent toward the connection part 141. As such, the bent portions 142*b* are formed on the plate extending from the upper end of the connection part 141 so that the movable rail rolling part 142 having the movable rail connection tracks 142*a* which are in rolling contact with the movable rail bearings 132 is formed on the plate.

The stationary rail rolling part 143 is integrally formed using a single plate on the lower end of the connection part 141. The integrally formed plate is bent from the connection part 141 downward and toward a second-side lower corner of the stationary sliding space 122 which is towards the center of the drawer 2 such that the plate is rounded to form the stationary rail connection track 143*a* on the upper surface thereof. This stationary rail connection track 143*a* is in rolling contact with a first-side lower portion (adjacent to the furniture 1) of the stationary rail bearing 131 which is in rolling contact with the second-side upper corner of the stationary sliding space 122. The plate which has been bent toward the second-side lower corner of the stationary sliding space 122 is bent toward the first-side upper corner of the stationary sliding space 122 and is rounded to form the stationary rail connection tracks 143*a* on the lower surface thereof. This stationary rail connection track 143*a* is in rolling contact with the second-side upper portion of the stationary rail bearing 131 which is in rolling contact with the first-side lower corner of the stationary sliding space 122. The plate which has been bent toward the first-side upper corner of the movable sliding space 112 is bent toward the connection part 141. As such, the bent portions 143*b* are formed on the plate extending from the lower end of the connection part 141 so that the stationary rail rolling part 143 having the stationary rail connection tracks 143*a* which are in rolling contact with the stationary rail bearings 131 is formed on the plate.

As mentioned above, the slider 140 is connected to the movable rail body 111 and the stationary rail body 121 while in rolling contact with them. The slider 140 includes the movable rail rolling part 142 which is supported by the movable rail body 111 in a rolling contact manner, the stationary rail rolling part 143 which is supported by the stationary rail body 121 in a rolling contact manner, and the connection part 141 which connects the movable rail rolling part 142 to the stationary rail rolling part 143. The slider 140 is integrally formed by bending a single plate.

The slider 140 can be formed without special restrictions by bending the integrated single plate regardless of the direction in which the plate is bent, so long as the rolling contact structure can be formed. In other words, the direction in which the plate is bent to form the slider 140 can be varied in a variety of manners, as long as the slider 140 can come into rolling contact with the bearings of the movable rail 110 and the stationary rail 120.

Figure 6:
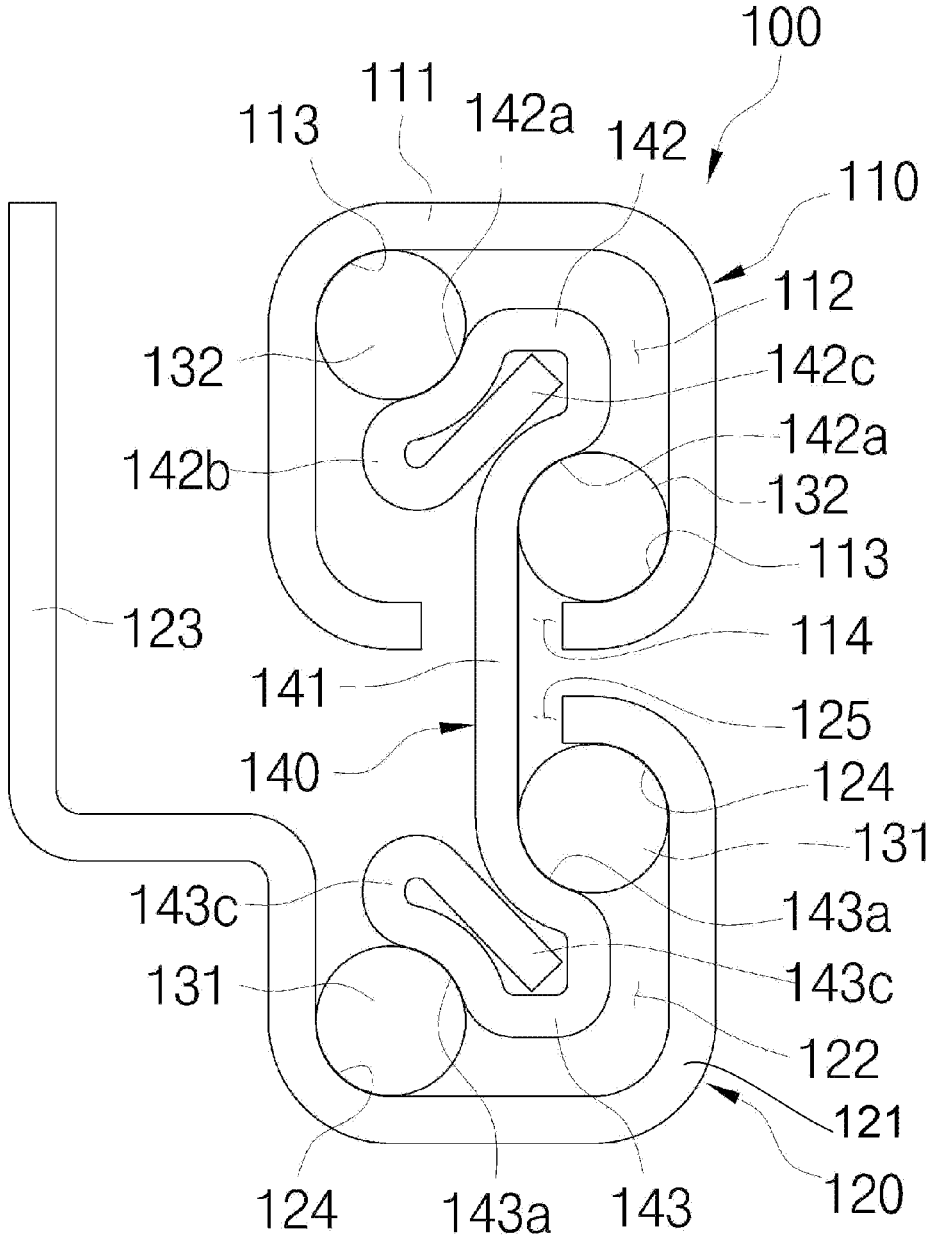
FIG. 6 is a sectional view showing another embodiment of the slider of the sliding device of FIG. 5.

Referring to FIG. 6, the movable rail rolling part 142 may further a curled portion 142*c* which extends from the end of the bent portion 142*b* adjacent to the connection part 141 into space defined by bending the movable rail rolling part 142 so that the movable rail rolling part 142 has a curling shape. The curled portion 142*c* is formed by curling up the end of the single plate which is exposed to the outside after the plate has been bent, so that the end of the plate is inserted into the space defined by bending the plate. Thus, the end of the plate that is inserted into the space defined in the movable rail rolling part 142 can be prevented from being exposed to the outside. Therefore, breakage or surface damage of the elements attributable to contact between the movable rail bearings 132 and the end of the plate can be minimized.

Furthermore, the stationary rail rolling part 143 may further a curled portion 143*c* which extends from the end of the bent portion 143*b* adjacent to the connection part 141 into space defined by bending the stationary rail rolling part 143 so that the stationary rail rolling part 143 has a curling shape. The curled portion 143*c* is formed by curling down the end of the single plate which is exposed to the outside after the plate has been bent, so that the end of the plate is inserted into the space defined by bending the plate. Thus, the end of the plate that is inserted into the space defined in the stationary rail rolling part 143 can be prevented from being exposed to the outside. Therefore, breakage or surface damage of the elements attributable to contact between the stationary rail bearings 131 and the end of the plate can be minimized.

In this structure, because the ends of the slider 140 having the integrated structure are prevented from being exposed to the outside, breakage or surface damage of the movable rail bearings 132 and the stationary rail bearings 131 which come into rolling contact with the slider 140 can be prevented. Therefore, the lifespan of the sliding device can be extended.

Hereinafter, force applied to the sliding device according to the first embodiment of the present invention when the drawer is extracted will be explained with reference to FIG. 7.

Figure 7:
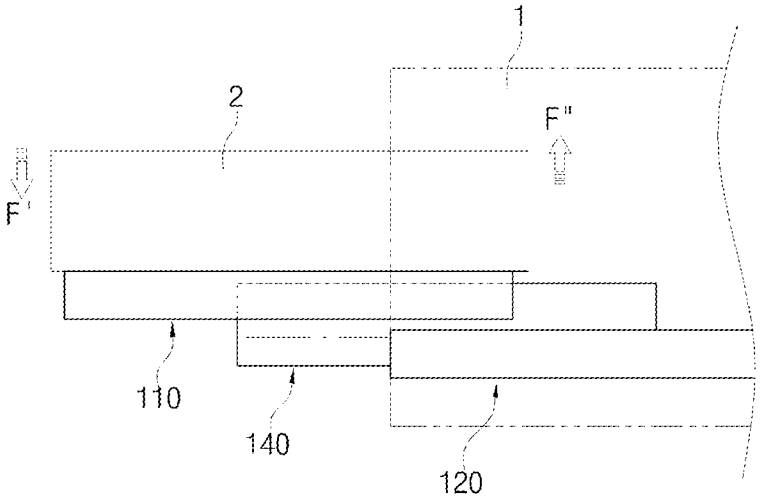
FIG. 7 is a side view showing forces applied to the sliding device of FIG. 2.

FIG. 7 is a side view showing forces applied to the sliding device of FIG. 2.

Referring to FIG. 7, when a user extracts the drawer 2 from the furniture 1 to put an object into the drawer 2 or remove an object from the drawer 2, a downward force F' is applied to the outer end of the extracted drawer 2 as a result of gravity by the weight of the drawer 2 and the object which has been contained in the drawer 2. When the downward force F' is applied to the outer end of the extracted drawer, an upward force F" is applied to the inner end of the drawer 2. As such, the forces F' and F" are applied to the outer end and the inner end of the drawer 2 in the opposite directions based on the drawer 2. The forces F' and F" applied to the drawer 2 are transmitted to the sliding device 100 via the movable rail 110. The forces F' and F" transmitted to the sliding device 100 is transmitted to the stationary rail 120 fastened to the furniture 1.

As stated above, the forces F' and F" transmitted from the drawer are applied to the sliding device 100 in opposite directions. In this embodiment, the two rows of movable rail tracks 113 with which the movable rail bearings 132 come into rolling contact are formed at positions facing each other in the movable rail 110 fastened to the drawer 2. In addition, the two rows of stationary rail tracks 124 with which the stationary rail bearing 131 come into rolling contact are formed in the stationary rail 120 fastened at positions facing each other to the furniture 1. The slider 140 is provided between the movable rail 110 and the stationary rail 120. The slider 140 comes into rolling contact with the movable rail bearings 132 and the stationary rail bearings 131 so that the slider 140 can slide with reference to the movable rail 110 and the stationary rail 120. As such, the two rows of movable rail tracks 113 with which the movable rail bearings 132 come into rolling contact are formed in the movable rail 110 and the two rows of stationary rail tracks 124 with which the stationary rail bearing 131 come into rolling contact are formed in the stationary rail 120. In other words, two rows of tracks, which are the minimum number of the power of two, are formed in each of the movable rail track 113 and the stationary rail track 124. The two rows of movable rail tracks 113 and the two rows of stationary rail tracks 124 are disposed in pairs to uniformly disperse the forces F' and F" which act in the opposite directions. Thus, in the sliding device 100 to which the upper force F' and the lower force F" are applied, the forces F' and F" can be uniformly dispersed on the movable rail tracks 113 and the stationary rail tracks 124, which are disposed in pairs, and with which the movable rail bearings 132 and the stationary rail bearings 131 respectively come into rolling contact. Accordingly, the sliding device 100 can be prevented from being deformed or damaged by the concentration of the forces F' and F" on a spot of the sliding device 100.

Below torsional force applied to the sliding device according to the first embodiment of the present invention when the drawer is extracted will be described with reference to FIG. 8.

Figure 8:
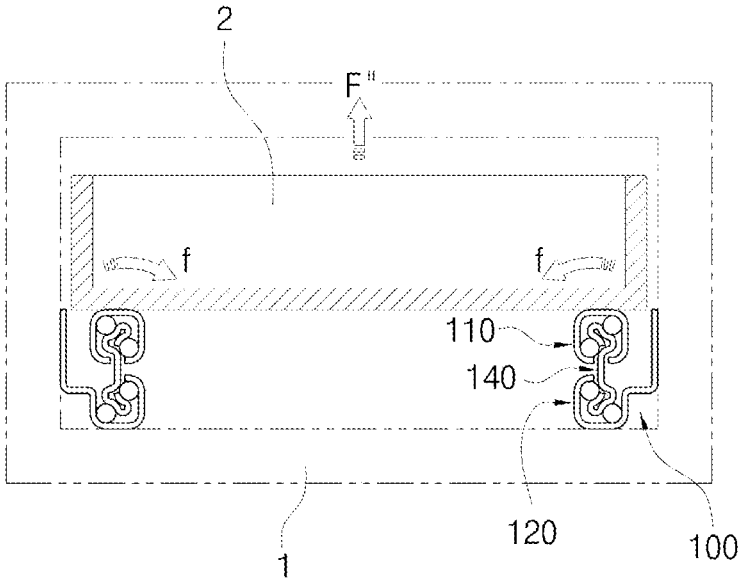
FIG. 8 is a sectional view showing torsional forces applied to the sliding device of FIG. 2.

FIG. 8 is a sectional view showing torsional forces applied to the sliding device of FIG. 2.

Referring to FIG. 8, when the drawer 2 is extracted, the downward force F' is applied to the outer end of the drawer 2, and the upward force F" which is reaction force to the downward force F' is applied to the inner end of the drawer 2. The upward force F" induces a torsional force f which is applied toward the center of the drawer to each of the sliding devices 100 which are installed under both the sides of the bottom of the drawer 2. The torsional force f acts as a force twisting the sliding device 100 toward the drawer 2. The torsional force f is concentrated on the sliding device 100 which has a rolling contact structure and is interposed between the drawer 2 and the furniture 1. Because the torsional force f is applied to the sliding device 100 toward the center of the drawer 2, it is concentrated on the center of the drawer-side surface of the slider 140 which is located at a medial portion of the sliding device 100. In other words, the force is concentrated on the center of the drawer-side surface of the slider 140 which is connected, in a rolling contact manner, between the movable rail 110 fastened to the drawer 2 and the stationary rail 120 fastened to the furniture 1. The force f concentrated on the slider 140 is supported by the movable rail bearing 132 and the stationary rail bearing 131 that are located adjacent to the center of the drawer 2. That is, the movable rail bearing 132 and the stationary rail bearing 131 are located as near to each other as possible toward the center of the drawer-side surface of the connection part 141. Thereby, resistance to the torsional force f can be increased. As such, in the present invention, the movable rail bearing 132 and the stationary rail bearing 131 that are adjacent to the center of the drawer 2 are located at positions appropriate to resist the torsional force f, thus preventing the torsional force f from being concentrated on one spot. Therefore, the sliding device 100 is prevented from being damaged or broken by the continuous concentration of the torsional force f, thereby increasing the lifespan thereof.

Hereinafter, a sliding device for a drawer according to a second embodiment of the present invention will be described in detail with reference to FIGS. 9 through 11.

Figure 9:
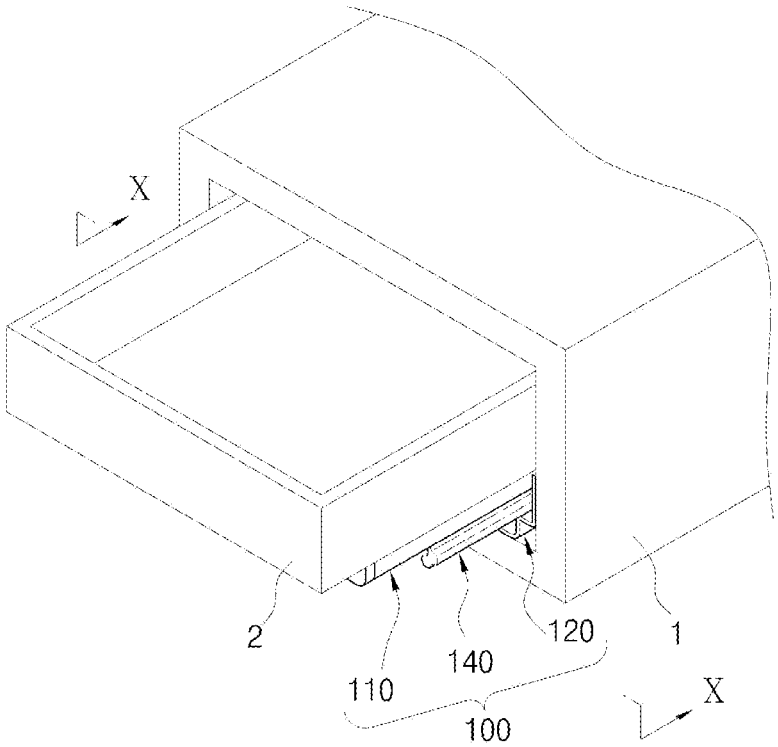
FIG. 9 is a perspective view illustrating the installation of a sliding device, according to a second embodiment of the present invention.

FIG. 9 is a perspective view illustrating the installation of the sliding device, according to the second embodiment of the present invention. FIG. 10 is a sectional view taken along line X-X of FIG. 9. FIG. 11 is a partial sectional view showing a main portion of the sliding device of FIG. 9.

Figure 10:
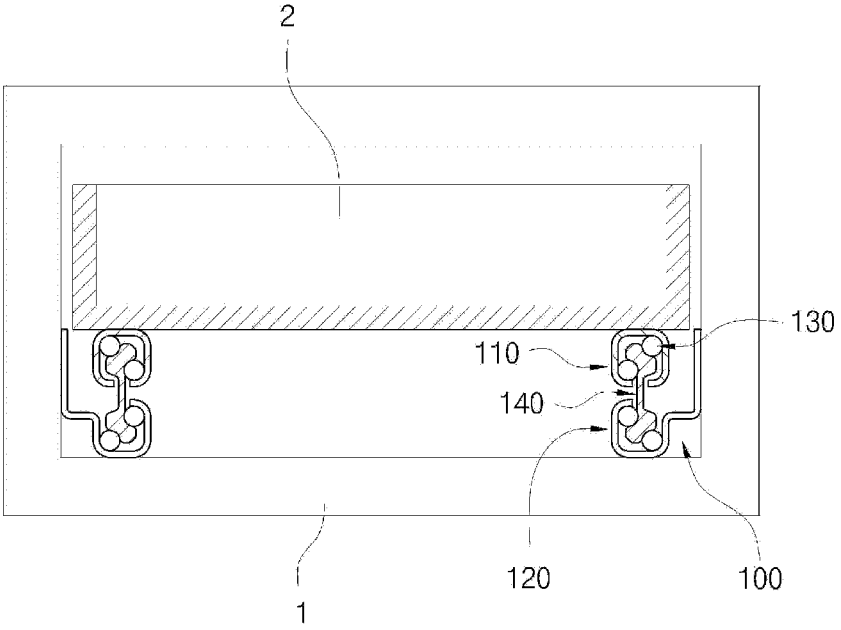
FIG. 10 is a sectional view taken along line X-X of FIG. 9.
Figure 11:
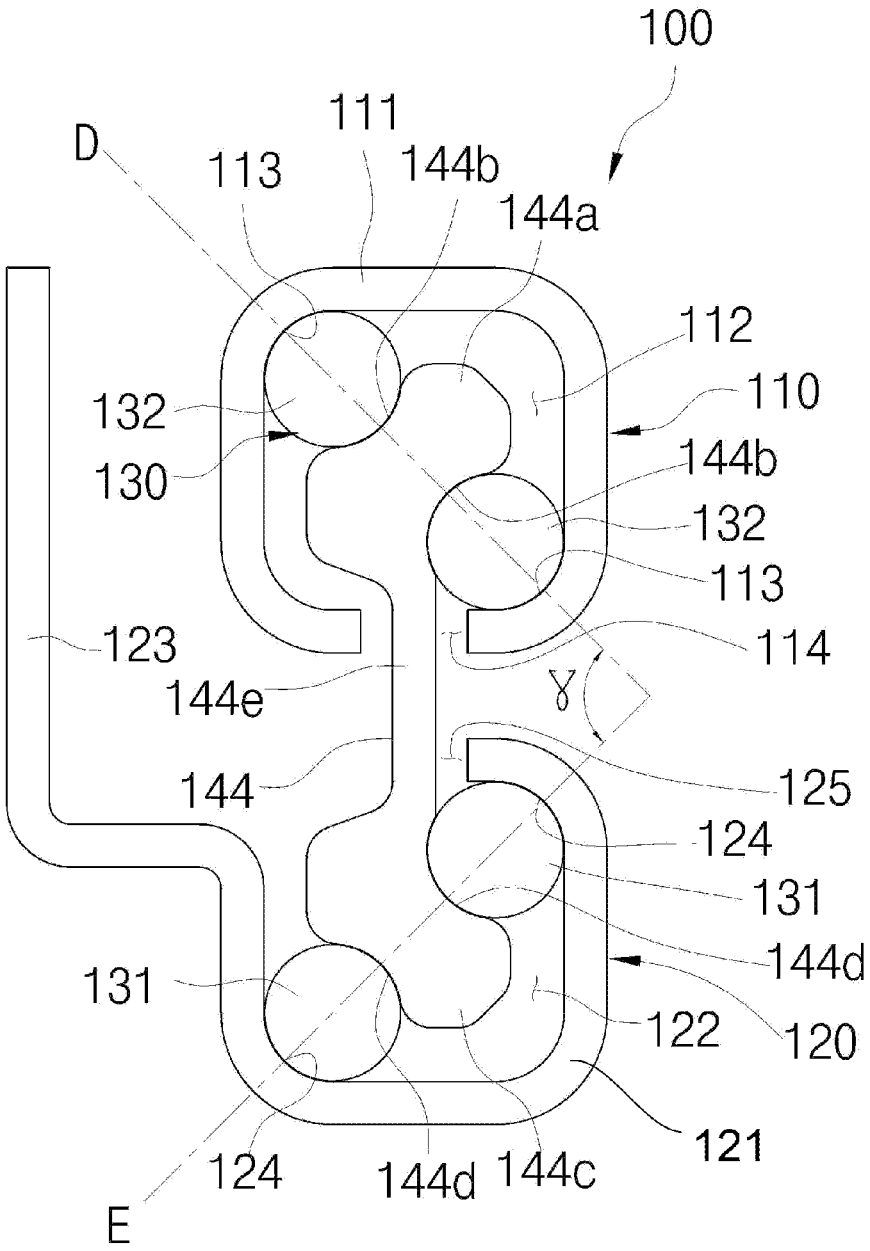
FIG. 11 is a partial sectional view showing a main portion of the sliding device of FIG. 9.

Referring to FIGS. 9 through 11, the sliding device 100 according to the second embodiment of the present invention includes a movable rail 110, a stationary rail 120, bearings 130 and a slider 144.

The movable rail 110 includes a movable rail body 111 which is provided under each of both sides of a drawer 2, and movable rail bearings 132. The movable rail bodies 111 of two movable rails 110 are fastened to both sides of the bottom of the drawer 2. A movable sliding space 112 is formed in the movable rail body 111. The movable rail body 111 has four corners. A connection opening 114 is formed through the bottom of the movable sliding space 112.

Movable rail tracks 113 are formed in the movable sliding space 112. The movable rail tracks 113 are located at the corners of the movable sliding space 112 which are diagonally facing each other. In detail, the movable rail tracks 113 are respectively located at the first-side upper corner that is adjacent to the furniture 1 and the second-side lower corner that is adjacent to the center of the drawer 2. Bearings 130 are in rolling contact with the movable rail tracks 113. Each movable rail track 113 which is in rolling contact with the corresponding bearing 130 is round.

The stationary rail 120 includes a stationary rail body 121 which is fastened to the furniture 1, a mounting bracket 123 and stationary rail tracks 124. In this embodiment, the stationary rail body 121 includes stationary rail bodies 121 which are fastened to the furniture 1 under the installation location of the drawer 2. In detail, each stationary rail body 121 is located under the corresponding movable rail body 111 so that the movable rail body 111 overlaps with the stationary rail body 121. A stationary sliding space 122 is formed in the stationary rail body 121. The stationary rail body 121 has three corners. A connection opening 125 is formed through a portion of the top of the stationary sliding space 122.

The mounting bracket 123 protrudes from the first-side surface of the stationary rail body 121 toward the furniture 1. In other words, the mounting bracket 123 is provided between the stationary rail body 121 and the furniture 1. The mounting bracket 123 is fastened to the furniture 1 so that the stationary rail body 121 is fastened to the furniture 1 by the mounting bracket 123.

The stationary rail tracks 124 are formed in the stationary sliding space 122. In detail, the stationary rail tracks 124 are respectively disposed at the first-side lower corner that is adjacent to the furniture 1 and at the second-side upper corner that is adjacent to the center of the drawer 2. The stationary rail tracks 124 are in rolling contact with bearings 130. Each stationary rail track 124 which is in rolling contact with the corresponding bearing 130 has a round shape.

The bearings 130 are configured so as to be able to roll. According to the location, the bearings 130 are classified into stationary rail bearings 131 and movable rail bearings 132. The stationary rail bearings 131 are installed in the stationary rail 120. The stationary rail bearings 131 are in rolling contact with the stationary rail tracks 124 which are located at the first-side lower corner and the second-side upper corner of the stationary sliding space 112. The stationary rail bearings 131 come into rolling contact with the slider 144. Thus, the slider 144 can slide on the stationary rail 120 by virtue of the stationary rail bearings 131.

The movable rail bearings 132 are installed in the movable rail 110. The movable rail bearings 132 are in rolling contact with the movable rail tracks 113 which are located at the first-side upper corner and the second-side lower corner of the movable sliding space 112. The movable rail bearings 132 come into rolling contact with the slider 144. Thus, the movable rail 110 can slide on slider 144 by virtue of the movable rail bearings 132.

In this embodiment, although the bearings 130 have been illustrated as having ball shapes, all typical rolling means can be used as them. For example, not only a ball but also a roller, or the like, which is able to roll may be used as each bearing 130.

Furthermore, the movable rail bearings 132 are disposed so that they come into rolling contact with the movable rail tracks 113 which are formed in two rows at the first-side upper corner and the second-side lower corner of the movable sliding space 112. The stationary rail bearings 131 are disposed so that they come into rolling contact with the stationary rail tracks 124 which are formed in two rows at the first-side lower corner and the second-side upper corner of the stationary sliding space 122. In other words, the movable rail tracks 113 and the stationary rail tracks 124 on which the movable rail bearings 132 and the stationary rail bearings 131 are disposed are formed in pairs at both sides to be a minimum number as they can support the movable rail 110 and the stationary rail 120. Depending on the length of the movable rail 110, the movable rail bearing 132 which is disposed on each movable rail track 113 may include a plurality of movable rail bearings 132. Depending on the length of the stationary rail 120, the stationary rail bearing 131 which is disposed on each stationary rail track 124 may include a plurality of stationary rail bearings 131.

Furthermore, the movable rail bearing 132 and the stationary rail bearing 131 which are located at the first side adjacent to the furniture 1 are spaced as far apart from each other as possible in the movable rail body 111 and the stationary rail body 121. That is, this movable rail bearing 132 comes into rolling contact with the first-side upper corner of the movable sliding space 112, and this stationary rail bearing 131 comes into rolling contact with the first-side lower corner of the stationary sliding space 122. As such, because the bearings 130 that are located at the first side adjacent to the furniture 1 are spaced as far apart from each other as possible in the movable rail 110 and the stationary rail 120, the resistance to outward force applied to the sliding device 100 can be enhanced. Therefore, these bearings 130 prevent the movable rail 110 or the stationary rail 120 from being deformed or damaged by outward force applied to the sliding device 100, thus extending the lifespan of the sliding device 100.

In addition, the movable rail bearing 132 and the stationary rail bearing 131 that are located at the second side adjacent to the center of the drawer 2 are as near to each other as possible in the movable rail body 111 and the stationary rail body 121. That is, this movable rail bearing 132 comes into rolling contact with the second-side lower corner of the movable sliding space 112, and this stationary rail bearing 131 comes into rolling contact with the second-side upper corner of the stationary sliding space 122. As such, because the bearings 130 that are located at the second side adjacent to the center of the drawer 2 are spaced as close to each other as possible in the movable rail 110 and the stationary rail 120, the resistance to the inward force concentrated on the sliding device 100 can be enhanced. Therefore, these bearings 130 prevent the movable rail 110 or the stationary rail 120 from being deformed or damaged by inward force concentrated on the sliding device 100, thus extending the lifespan of the sliding device 100.

Meanwhile, when an upper center connection line D connecting the centers of the movable rail bearings 132 to each other and a lower center connection line E connecting the centers of the stationary rail bearings 131 to each other extend toward the center of the drawer 2, an angle γ defined between the upper center connection line D and the lower center connection line E ranges from 80 degrees to 100 degrees. The optimum angle γ between the upper center connection line D and the lower center connection line E is 90 degrees.

If the angle γ is less than 80 degrees, the distance between the first-side bearings 130 that are adjacent to the furniture 1 is reduced, thus markedly reducing the resistance to outward force applied to the sliding device 100. Therefore, when the angle γ is less than 80 degrees, the sliding device 100 may be deformed or damaged by outward force applied to the sliding device 100. Thereby, the lifespan of the sliding device 100 may be reduced.

Furthermore, if the angle γ is greater than 100, the distance between the first-side bearings 130 that are adjacent to the furniture 1 is increased, thus reducing the resistance to force concentrated on the central portion of the second side of the sliding device 100 that is adjacent to the center of the drawer 2. Therefore, when the angle γ is greater than 100, the sliding device 100 may be deformed or damaged by force concentrated on the central portion of the second side of the sliding device 100. Thereby, the lifespan of the sliding device 100 may be reduced.

Accordingly, when the angle γ desirably ranges from 80 degrees to 100 degrees, the sliding device 100 can realize the stable structure which can resist the outward force and force concentrated on the central portion of the second side of the sliding device 100 that is adjacent to the center of the drawer 2. Then, the sliding device 100 can be prevented from being deformed or damaged by force applied thereto, thus extending the lifespan thereof.

The slider 144 includes a movable rail-side sliding part 144*a*, a stationary rail-side sliding part 144*c* and a connection part 144*e*. The movable rail-side sliding part 144*a* is located in the movable sliding space 112. The movable rail-side sliding part 144*a* has a shape which protrudes from the first-side lower corner of the movable sliding space 112 to the second-side upper corner so that the movable rail bearings 132 are in rolling contact with the movable rail-side sliding part 144*a*. Round movable rail connection tracks 144*b* are formed on an upper surface and a lower surface of the movable rail-side sliding part 144*a* which respectively face the first-side upper corner and the second-side lower corner of the movable sliding space 112. The movable rail bearings 132 which are located on the facing corners of the movable sliding space 112 come into rolling contact with the corresponding movable rail connection tracks 144*b*. In detail, the first-side movable rail connection track 144*b* comes into rolling contact with a second-side lower portion of the movable rail bearing 132 that is located in the first-side upper corner of the movable sliding space 112. The second-side movable rail track 144*b* comes into rolling contact with a first-side upper portion of the movable rail bearing 132 that is located in the second-side lower corner of the movable sliding space 112.

The stationary rail-side sliding part 144*c* is located in the stationary sliding space 122. The stationary rail-side sliding part 144*c* has a shape which protrudes from the first-side lower corner of the movable sliding space 112 to the second-side upper corner so that the stationary rail bearings 131 are in rolling contact with the stationary rail-side sliding part 144*c*. Round stationary rail connection tracks 144*d* are formed on an upper surface and a lower surface of the stationary rail-side sliding part 144*c* which respectively face the first-side lower corner and the second-side upper corner of the stationary sliding space 122. The stationary rail bearings 131 which are located on the facing corners of the stationary sliding space 122 come into rolling contact with the corresponding stationary rail connection tracks 144*d*. In detail, the first-side stationary rail connection track 144*d* comes into rolling contact with a second-side upper portion of the stationary rail bearing 131 that is located in the first-side lower corner of the stationary sliding space 122. The second-side stationary rail connection track 144*d* comes into rolling contact with a first-side lower portion of the stationary rail bearing 131 that is located in the second-side upper corner of the stationary sliding space 122.

The connection part 144*e* connects the movable rail-side sliding part 144*a* to the stationary rail-side sliding part 144*c*. Upper and lower ends of the connection part 144*e* are respectively inserted into the movable sliding space 112 and the stationary sliding space 122 through the connection opening 114 and the connection opening 125. The connection part 144*e* is located between the movable rail 110 and the stationary rail 120. The movable rail-side sliding part 144*a* and the stationary rail-side sliding part 144*c* are symmetric at upper and lower sides with respect to the connection part 144*e*.

As such, the slider 144 connects the movable rail 110 to the stationary rail 120 and come into rolling contact with the bearings 130 which are installed in the movable rail 110 and the stationary rail 120. Thus, the movable rail 110 comes into rolling contact with the slider 144, which is located below, so as to be slidable on the slider 144. In addition, the slider 144 comes into rolling contact with the stationary rail 120, which is located below, so as to be slidable on the stationary rail 120. The contour of the cross-section of the slider 144 forms a closed curve. The slider 144 is integrally formed into a single body using a solid material.

The slider which is a main part of the sliding device according to the second embodiment of the present invention will be explained in detail with reference to FIG. 12.

Figure 12:
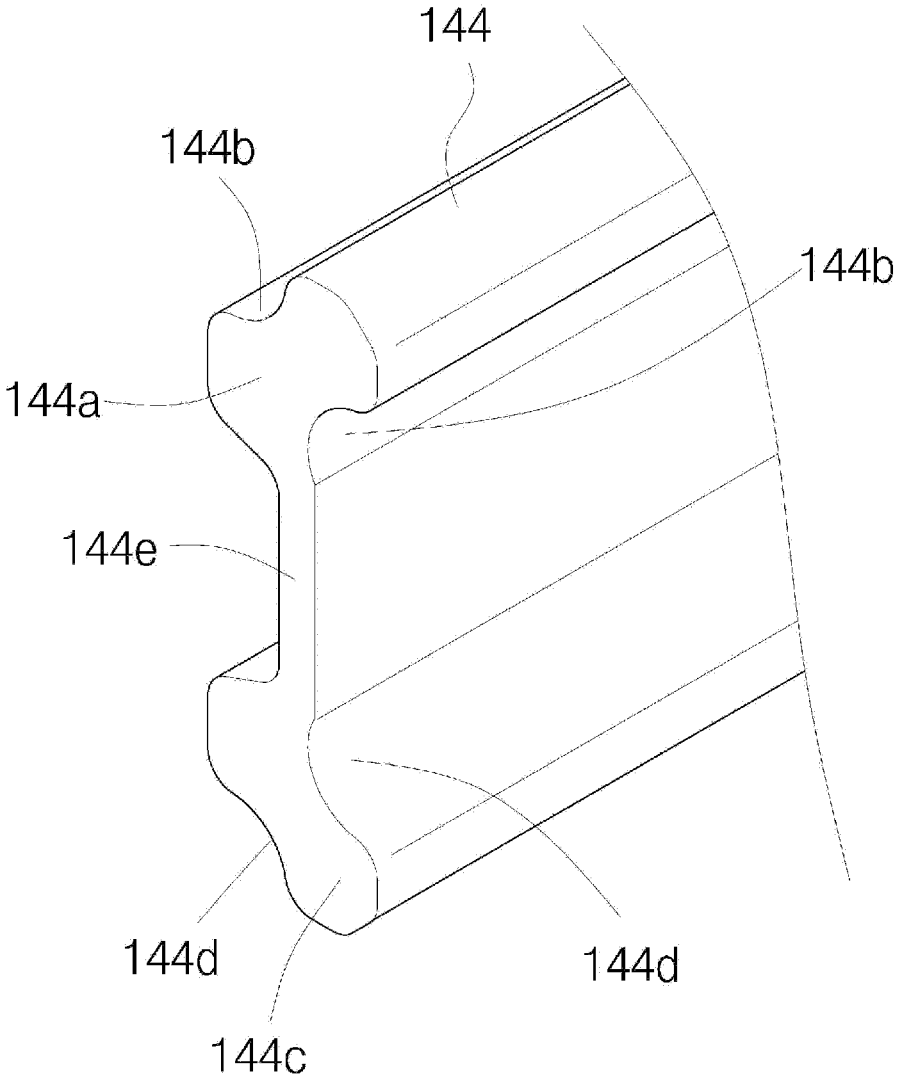
FIG. 12 is a partial perspective view showing a slider which is a main portion of the sliding device of FIG. 9.

Referring to FIG. 12, the contour of the cross-section of the slider 144 has a closed curve shape. In other words, the entirety of the outer surface of the slider 144 is exposed to the outside. The slider 144 has an integrated structure. To plate the entirety of the outer surface of the slider 144 which is exposed to the outside, the entire surface of the slider 144 is uniformly washed. After washing, the outer surface of the slider 144 is plated. Then, a plating solution is uniformly deposited on the entirety of the outer surface of the slider 144. Thus, the outer surface of the slider 144 can be uniformly plated. As such, the plating performance can be enhanced.

Furthermore, because the slider 144 is integrally formed into a single body using a solid material, it can be processed using a metal mold, for example, by rolling, drawing, etc. The rolling or drawing process is simpler than the bending process, so that the process of forming the slider 144 can be rapidly conducted, thus reducing the processing cost. That is, in the bending process, a plate is bent several times to form the slider. Every time it is bent, a bending machine must be adjusted, and the shape to be formed by bending is also complex. However, in the rolling or drawing process, the slider is manufactured in such a way that a solid material is pressed by rollers or molds. Therefore, the process is simplified, and the time taken to manufacture can be reduced. Moreover, because the integrated solid material is used and the contour of the cross section thereof forms a closed curve, the surface area of the slider is markedly reduced compared to that of the slider produced by bending. Hence, the area to be plated is also reduced, thus reducing the plating cost. In addition, the slider 144 has the symmetric shape at upper and lower sides, thus making the processing easier.

Also, because the slider 144 has the single body and the contour of the cross section thereof forms a closed curve, it can be produced by processing the outer shape of a solid material. Processing the outer shape of the solid material can be embodied by rolling or drawing. Furthermore, when the outer shape of the solid material is processed to form the slider 144, pressure is applied to the surface of the solid material, so that the surface hardness thereof can be enhanced. It is typically well-known that enhancement of the surface hardness increases abrasion resistance. That is, pressing the surface of the solid material makes the tissue of the solid material dense and makes a rough surface even. Thus, resistance to the rolling contact is reduced. Therefore, the abrasion resistance of the processed slider 144 can be enhanced, so that the lifespan thereof is extended.

Moreover, because the slider 144 is solid, the strength thereof is enhanced, and water or other foreign substances cannot permeate the slider 144. The enhancement of the strength of the slider 144 increases the resistance to force applied thereto. The slider 144 is prevented from corroding attributable to water. Therefore, the lifespan of the slider 144 can be extended.

Hereinafter, force applied to the sliding device according to the second embodiment of the present invention when the drawer is extracted will be explained with reference to FIG. 13.

Figure 13:
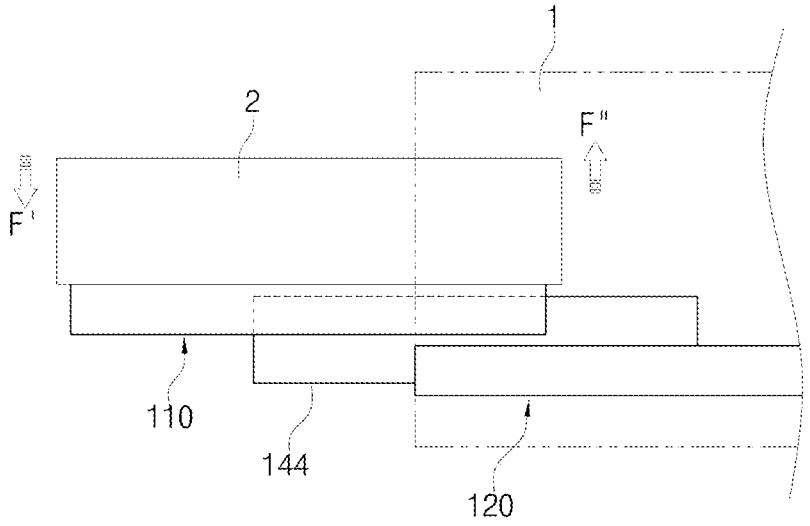
FIG. 13 is a side view showing forces applied to the sliding device of FIG. 9.

Referring to FIG. 13, when a user extracts the drawer 2 from the furniture 1 to put an object into the drawer 2 or take out an object from the drawer 2, a downward force F' is applied to the outer end of the extracted drawer 2 as a result of gravity by the weight of the drawer 2 and the object which has been contained in the drawer 2. When the downward force F' is applied to the outer end of the extracted drawer, an upward force F" is applied to the inner end of the drawer 2. As such, the forces F' and F" are applied to the outer end and the inner end of the drawer 2 in the opposite directions based on the drawer 2. The forces F' and F" applied to the drawer 2 are transmitted to the sliding device 100 via the movable rail 110. The forces F' and F" transmitted to the sliding device 100 are transmitted to the stationary rail 120 fastened to the furniture 1.

As stated above, the forces F' and F" transmitted from the drawer are applied to the sliding device 100 in opposite directions. In this embodiment, the two rows of movable rail tracks 113 with which the movable rail bearings 132 come into rolling contact are formed at positions facing each other in the movable rail 110 fastened to the drawer 2. In addition, the two rows of stationary rail tracks 124 with which the stationary rail bearing 131 come into rolling contact are formed at positions facing each other in the stationary rail 120 fastened to the furniture 1.

The slider 144 is provided between the movable rail 110 and the stationary rail 120. The two rows of movable rail connection tracks 144*b* and the two rows of stationary rail connection tracks 144*d* with which the movable rail bearings 132 and the stationary rail bearings 131 come into rolling contact are formed in the slider 144.

The movable rail tracks 113 and the movable rail connection tracks 144*b* with which the movable rail bearings 132 come into rolling contact are formed in two rows at the upper side of the sliding device. The stationary rail tracks 124 and the stationary rail connection tracks 144*d* with which the stationary rail bearings 131 come into rolling contact are formed in two rows at the lower side of the sliding device. As such, the sliding device has the two rows of movable rail tracks 113 and the two rows of movable rail connection tracks 144*b*, with which the movable rail bearings 132 come into rolling contact, and the two rows of stationary rail tracks 124 and the two rows of stationary rail connection tracks 144*d*, with which the stationary rail bearings 131 come into rolling contact. In other words, the two rows of tracks, which are the minimum number of the power of two, coming into contact with the movable rail bearings 132 and the two rows of tracks coming into contact with the stationary rail bearings 131 are disposed in pairs at upper and lower sides of the sliding device to uniformly disperse the forces F' and F" which act in opposite directions.

Thus, in the sliding device 100 to which the upper force F' and the lower force F" are applied, the forces F' and F" can be uniformly dispersed on the movable rail tracks 113, the movable rail connection tracks 144*b*, the stationary rail tracks 124 and the stationary rail connection tracks 144*d*. Accordingly, the sliding device 100 can be prevented from being deformed or damaged by the concentration of the forces F' and F" on a spot of the sliding device 100.

Hereinafter, torsional force applied to the sliding device according to the second embodiment of the present invention when the drawer is extracted will be described with reference to FIG. 14.

Figure 14:
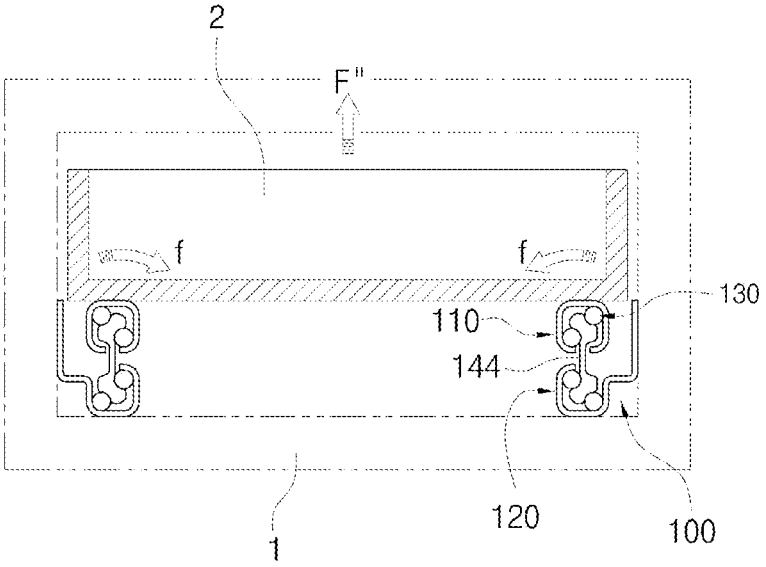
FIG. 14 is a sectional view showing torsional forces applied to the sliding device of FIG. 9.

FIG. 14 is a sectional view showing torsional forces applied to the sliding device of FIG. 9.

Referring to FIG. 14, when the drawer 2 is extracted, the downward force F' is applied to the outer end of the drawer 2, and the upward force F" which is reaction force to the downward force F' is applied to the inner end of the drawer 2. The upward force F" induces a torsional force f which is applied toward the center of the drawer to each of the sliding devices 100 which are installed under both the sides of the bottom of the drawer 2. The torsional force f acts as force of twisting the sliding device 100 toward the drawer 2. The torsional force f is concentrated on the sliding device 100 which has the rolling contact structure and is interposed between the drawer 2 and the furniture 1. Because the torsional force f is applied to the sliding device 100 toward the center of the drawer 2, it is concentrated on the center of the drawer-side surface of the slider 144 which is located at a medial portion of the sliding device 100. In other words, the force is concentrated on the center of the drawer-side surface of the slider 144 which is connected, in a rolling contact manner, between the movable rail 110 fastened to the drawer 2 and the stationary rail 120 fastened to the furniture 1. The force f concentrated on the slider 144 is supported by the movable rail bearing 132 and the stationary rail bearing 131 that are located adjacent to the center of the drawer 2. That is, these movable rail bearing 132 and stationary rail bearing 131 are located as near to each other as possible toward the center of the drawer-side surface of the connection part 141. Thereby, resistance to the torsional force f can be increased. As such, in the present invention, the movable rail bearing 132 and the stationary rail bearing 131 that are adjacent to the center of the drawer 2 are located at positions appropriate to resist the torsional force f, thus preventing the torsional force f from being concentrated on one spot. Therefore, the sliding device 100 is prevented from being damaged or broken by the continuous concentration of the torsional force f, thereby increasing the lifespan thereof.

Although the embodiments of the present invention have been disclosed for illustrative purposes, those skilled in the art will appreciate that various modifications, additions and substitutions are possible, without departing from the scope and spirit of the invention as disclosed in the accompanying claims.

As described above, the present invention provides a sliding device which is disposed at each of both sides of a movable body and is operated so that when the movable body is extracted from or retracted into the stationary support, the movable body slides with respect to the stationary support. In the sliding device of the present invention, the number of elements can be minimized despite providing a stable structure which can effectively disperse forces applied to the movable body in a variety of directions. Therefore, there is an advantage in that the size of the sliding device can be reduced.

Furthermore, in the case where the contour of the cross section of a slider which is installed in the sliding device and operated in a rolling manner has a closed curve shape, because the slider can be produced by forming a solid material, the strength thereof is enhanced. The surface hardness of the slider can be increased when it is processed, thus enhancing the abrasion resistance.

In particular, in cases where the contour of the cross-section of the slider has a closed curve shape, during a plating process, a plating solution can be uniformly deposited on the entirety of the outer surface of the slider, so that the plating effect is improved. Thereby, the lifespan of the sliding device can be extended.

Moreover, in the slider having such a solid structure, even though it is used in a place, such as a refrigerator, where the humidity is high, water is prevented from permeating the slider so that corrosion can be avoided.

Furthermore, the sliding device is configured so that rolling bearings are disposed at symmetric positions with respect to the center of the slider, and the slider which comes into rolling contact with the bearings has a symmetric structure. In other words, the upper end and the lower end of the slider have the same symmetric shape, and the bearings are located at the symmetric positions. Therefore, it is easy to manufacture and assemble the sliding device.

Moreover, the sliding device is configured so that the minimal optimal number of tracks on which the bearings roll can effectively disperse upward force and downward force applied to the movable body. Thus, the sliding device has a stable structure which can effectively resist the force applied thereto. Therefore, the lifespan of the sliding device can be increased. In addition, because the number of elements is reduced, the size of the sliding device can be reduced, and the production cost can be reduced.

The present invention provides a sliding device which has a simple structure and is able to stably support various types of forces applied to a movable body, so that the forces applied thereto are effectively dispersed, thus extending the lifespan, and reducing the size of the sliding device. Furthermore, the sliding device which is reduced in size and has an extended lifespan can be produced at a low production cost. Therefore, the present invention can be widely used in fields related to sliding devices.

What is claimed is:

1. A sliding device for making a movable body slidable with respect to a stationary support, the sliding device comprising:

a movable rail body to be attached to the movable body, the movable rail body having a first upper corner and a first lower corner diagonally facing each other and a second upper corner and a second lower corner diagonally facing each other, the movable rail body having a first opening on a bottom thereof and having a first space defined in the movable rail body;

movable rail bearings comprised of first movable rail bearings and second movable rail bearings disposed in the first space at the first upper corner and the first lower corner, respectively, the first movable rail bearings rolling in contact with the first upper corner, the second movable rail bearings rolling in contact with the first lower corner of the movable rail body;

a stationary rail body to be fastened to the stationary support and disposed below the movable rail body, the stationary rail body having a second opening on a top thereof and having a second space defined in the stationary rail body, the second opening facing the first opening, the stationary rail body having a third upper corner, a third lower corner diagonally facing the third upper corner, and a fourth lower corner;

stationary rail bearings disposed in the second space at opposite corners of the stationary rail body which diagonally face each other, the stationary rail bearings rolling in contact with the stationary rail body; and a slider comprising:

a movable rail rolling part located in the first space of the movable rail body, the movable rail rolling part having a single pair of movable rail connection tracks comprised of a first movable rail connection track facing the first upper corner and a second movable rail connection track facing the first lower corner, the first and second movable rail connection tracks coming into rolling contact with the first and second movable rail bearings, respectively;

a stationary rail rolling part located in the stationary rail body, the stationary rail rolling part having a single pair of stationary rail connection tracks coming into rolling contact with the stationary rail bearings facing each other; and a connection part connecting the movable rail rolling part to the stationary rail rolling part, the connection part vertically extended from the first space to the second space through the first opening and the second opening;

wherein the slider in the movable rail body diagonally extends toward the second upper corner of the movable rail body, the slider diagonally extended toward the second upper corner of the movable rail body is bent to form a first sub-bent portion, and the slider extended from the first sub-bent portion diagonally extends toward the second lower corner of the movable rail body;

wherein the slider in the stationary rail body diagonally extends toward the fourth lower corner of the stationary rail body, the slider diagonally extended toward the fourth lower corner of the stationary rail body is bent to form a second sub-bent portion, and the slider extended from the second sub-bent portion diagonally extends in a direction opposite to the fourth lower corner of the stationary rail body;

wherein the movable rail bearings are disposed facing each other so that an angle between a center line extending from a center of the slider in a direction parallel to the movable body and a center connection line connecting centers of the movable rail bearings facing each other ranges from 40 degrees to 50 degrees;

the stationary rail bearings are disposed facing each other so that an angle between the center line extending from the center of the slider in the direction parallel to the movable body and a center connection line connecting centers of the stationary rail bearings facing each other ranges from 130 degrees to 140 degrees; and the movable rail bearings and the stationary rail bearings are respectively disposed above and below the center of the slider and are symmetric with respect to the center line of the slider.

2. The sliding device as set forth in claim 1, further comprising:

a mounting bracket protruding from the stationary rail body toward the stationary support so that the stationary rail body is fastened to the stationary support by the mounting bracket.

3. The sliding device as set forth in claim 1, wherein round stationary rail tracks are formed on inner surfaces of the opposite corners of the stationary rail body that are in contact with the corresponding stationary rail bearings.

4. The sliding device as set forth in claim 1, wherein the movable rail rolling part and the stationary rail rolling part are symmetric on upper and lower ends of the connection part with respect to the connection part.

5. The sliding device as set forth in claim 4, wherein a plurality of first bent portions including the first sub-bent portion is formed in the movable rail rolling part; and a plurality of second bent portions including the second sub-bent portion is formed in the stationary rail rolling part.

6. The sliding device as set forth in claim 1, wherein the slider extended toward the second lower corner is curled to form a first curled portion, and the slider extended from the first curled portion extends toward the second upper corner, and the slider diagonally extended in the direction opposite to the fourth lower corner of the stationary rail body is curled to form a second curled portion, and the slider extended from the second curled portion extends toward the fourth lower corner of the stationary rail body.

7. Furniture provided with the sliding device of claim 1.

8. A refrigerator provided with the sliding device of claim 1.

9. An oven provided with the sliding device of claim 1.

10. The sliding device as set forth in claim 1, wherein the slider is a straightly extended from the first opening to the second opening.

11. The sliding device as set forth in claim 1, wherein the movable rail body has four corners comprised of the first upper corner and the first lower corner diagonally facing each other, and a second upper corner and a second lower corner diagonally facing each other; and the movable rail body has the first opening between the first lower corner and the second lower corner.

12. A sliding device for making a movable body slidable with respect to a stationary support, the sliding device comprising:

a movable rail to be attached to the movable body, the movable rail having a first space defined in the movable rail, the movable rail comprising:

a movable rail body fastened to the bottom of the movable body so that the movable rail body is movable along the movement of the movable body moves, the movable rail body having a first upper corner and a first lower corner diagonally facing each other and a second upper corner and a second lower corner diagonally facing each other, the movable rail body having a first opening on a bottom of the first space; and a single pair of movable rail tracks having a first movable rail track formed on the first upper corner and a second movable rail track formed on the first lower corner;

a stationary rail to be fastened to the stationary support and disposed below the movable rail, the stationary rail having a second space defined in the stationary rail, the stationary rail comprising:

a stationary rail body disposed below the movable rail such that the movable rail overlaps with the stationary rail body, the stationary rail body having a second opening on a top of the second space, the stationary rail body having a third upper corner, a third lower corner diagonally facing the third upper corner, and a fourth lower corner; and a single pair of stationary rail tracks formed on opposite corners diagonally facing each other in the second space;

a slider extending from the first space and the second space through the first opening and the second opening, the slider having a single pair of movable rail connection tracks comprised of a first movable rail connection track facing the first movable rail track and a second movable rail connection track facing the second movable rail track in the first space and a single pair of stationary rail connection tracks in the second space; and first bearings provided between the first movable rail track and the first movable rail connection track and between the second movable rail track and the second movable rail connection track, second bearings provided on the opposite corners diagonally facing each other in the second space, the first bearings and the second bearings rolling in contact with the movable rail and the stationary rail, respectively;

wherein the slider in the movable rail body diagonally extends toward the second upper corner of the movable rail body, the slider diagonally extended toward the second upper corner of the movable rail body is bent to form a first sub-bent portion, and the slider extended from the first sub-bent portion diagonally extends toward the second lower corner of the movable rail body;

wherein the slider in the stationary rail body diagonally extends toward the fourth lower corner of the stationary rail body, the slider diagonally extended toward the fourth lower corner of the stationary rail body is bent to form a second sub-bent portion, and the slider extended from the second sub-bent portion diagonally extends in a direction opposite to the fourth lower corner of the stationary rail body;

wherein when a first extension line connecting centers of the first bearings provided on the opposite corners diagonally facing each other in the first space extends toward the movable body and a second extension line connecting centers of the second bearings provided on the opposite corners diagonally facing each other in the second space extends toward the movable body, an angle between the first and second extension lines ranges from 80 degrees to 100 degrees; and the slider is integrally solid and has a cross section of which a contour forms a closed curve.

13. The sliding device as set forth in claim 12, wherein the stationary rail further comprises:

a mounting bracket fastening the stationary rail body to the stationary support.

14. The sliding device as set forth in claim 12, wherein the slider comprises:

a movable rail-side sliding part disposed in the movable rail, the movable rail-side sliding part having a single pair of movable rail connection tracks coming into rolling contact with the first bearings;

a stationary rail-side sliding part disposed in the stationary rail, the stationary rail-side sliding part having a single pair of stationary rail connection tracks coming into rolling contact with the second bearings; and a connection part connecting the movable rail-side sliding part to the stationary rail-side sliding part through the open bottom of the movable rail and the open top of the stationary rail, wherein the movable rail-side sliding part, the stationary rail-side sliding part and the connection part form a solid integrated structure having a cross section of which a contour forms a closed curve.

15. Furniture provided with the sliding device of claim 12.

16. A refrigerator provided with the sliding device of claim 12.

17. An oven provided with the sliding device of claim 12.

18. The sliding device as set forth in claim 12, wherein the slider is straightly extended from the first opening and the second opening.

19. The sliding device as set forth in claim 12, wherein the movable rail body has four corners comprised of the first upper corner and the first lower corner diagonally facing each other, and a second upper corner and a second lower corner diagonally facing each other; and the movable rail body has the first opening between the first lower corner and the second lower corner.

* * * * *